US010243253B2

(12) United States Patent
Kasahara

(10) Patent No.: US 10,243,253 B2
(45) Date of Patent: Mar. 26, 2019

(54) ANTENNA, PRINTED CIRCUIT BOARD, AND ELECTRONIC DEVICE

(71) Applicant: NEC Corporation, Minato-ku, Tokyo (JP)

(72) Inventor: Yoshiaki Kasahara, Tokyo (JP)

(73) Assignee: NEC CORPORATION, Tokyo (JP)

( * ) Notice: Subject to any disclaimer, the term of this patent is extended or adjusted under 35 U.S.C. 154(b) by 53 days.

(21) Appl. No.: 15/032,492

(22) PCT Filed: Jul. 17, 2014

(86) PCT No.: PCT/JP2014/069005
§ 371 (c)(1),
(2) Date: Apr. 27, 2016

(87) PCT Pub. No.: WO2015/068430
PCT Pub. Date: May 14, 2015

(65) Prior Publication Data

US 2016/0276733 A1 Sep. 22, 2016

(30) Foreign Application Priority Data

Nov. 5, 2013 (JP) ..... 2013-229267

(51) Int. Cl.
*H01Q 9/04* (2006.01)
*H01Q 21/06* (2006.01)
(Continued)

(52) U.S. Cl.
CPC ..... *H01Q 1/2216* (2013.01); *H01Q 9/0407* (2013.01); *H01Q 19/005* (2013.01); *H01Q 21/065* (2013.01)

(58) Field of Classification Search
CPC .. H01Q 19/005; H01Q 9/0407; H01Q 9/0414; H01Q 9/0421; H01Q 21/065
See application file for complete search history.

(56) References Cited

U.S. PATENT DOCUMENTS 7,446,712 B2 * 11/2008 Itoh ..... H01Q 13/206 343/700 MS
2007/0075903 A1 4/2007 Matsugatani et al.
2008/0088510 A1 4/2008 Murata et al.

FOREIGN PATENT DOCUMENTS

JP 2000-183637 A 6/2000
JP 2005-124061 A 5/2005
(Continued)

OTHER PUBLICATIONS

International Search Report for PCT Application No. PCT/JP2014/069005, dated Oct. 28, 2014.
(Continued)

*Primary Examiner* — Tho G Phan
*Assistant Examiner* — Patrick R Holecek

(57) ABSTRACT

An antenna comprises: a conductor plane; an island-shaped conductor group which is arranged to face the conductor plane with a dielectric medium therebetween; at least one power feeding part which is connected to one island-shaped conductor of the island-shaped conductor group and transmits power; and a connection part which electrically connects the conductor plane and a first island-shaped conductor that is an island-shaped conductor located on the outermost side of the island-shaped conductor group. Each of island-shaped conductors is capacitively connected to another island-shaped conductor adjacent thereto, the power feeding part is connected at a position other than the center of the island-shaped conductor in the arrangement direction of the island-shaped conductor group, and the connection part is connected at a position inside the first island-shaped conductor by approximately half the width of a second island-shaped conductor, which is an island-shaped conductor located adjacent to the first island-shaped conductor, in the arrangement direction of the island-shaped conductor group
(Continued)

from a portion facing the second island-shaped conductor of the edge of the first island-shaped conductor.

10 Claims, 32 Drawing Sheets

(51) Int. Cl.
*H01Q 1/22* (2006.01)
*H01Q 19/00* (2006.01)

(56) References Cited

FOREIGN PATENT DOCUMENTS

| | | | |
|---|---|---|---|
| JP | 2008-312263 | A | 12/2008 |
| JP | 2013-093642 | A | 5/2013 |
| WO | 2012/177946 | A2 | 12/2012 |

OTHER PUBLICATIONS

English translation of Written opinion for PCT Application No. PCT/JP2014/069005.

* cited by examiner

※ POWER FEEDING PART 104 OR RESISTANCE COMPONENTS RESULTING FROM RADIATION RESISTANCE, CONDUCTOR LOSS, AND DIELECTRIC LOSS ARE NOT CONSIDERED.

ANTENNA, PRINTED CIRCUIT BOARD, AND ELECTRONIC DEVICE

This application is a National Stage Entry of PCT/JP2014/069005 filed on Jul. 17, 2014, which claims priority from Japanese Patent Application 2013-229267 filed on Nov. 5, 2013, the contents of all of which are incorporated herein by reference, in their entirety.

TECHNICAL FIELD

The present invention relates to an antenna, and a printed circuit board and an electronic device including the antenna.

BACKGROUND ART

A system using an IC tag such as RFID (Radio Frequency Identification) is widely used for information management of articles and the like. As radio-wave-using parts in such a system, an IC tag and a reader/writer antenna are cited. Further, as the reader/writer antenna, a patch antenna or a dipole antenna is generally used. A size of the patch antenna or the dipole antenna is determined by a resonance length that depends on a wavelength, and is therefore commonly larger than a size of the IC tag. When such an antenna resonates, a node occurs in an electric field distribution or a magnetic field distribution. Therefore, in a position that is a node of electric field intensity or magnetic field intensity in a vicinity of an antenna, an area where an IC tag is difficult to read occurs.

As a technique for solving such a problem, conceivable is a technique in which a size of an antenna is reduced to substantially the same size as an IC tag and a portion having strong electric field intensity or magnetic field intensity is caused to be always present in an area where the IC tag is present. One example of an antenna using such a technique is disclosed in Patent Literature 1 (PTL 1).

CITATION LIST

Patent Literature

[PTL 1] Japanese Laid-open Patent Application Publication No. 2000-183637

SUMMARY OF INVENTION

Technical Problem

However, when an antenna is downsized, radiation efficiency thereof is also decreased. Therefore, when an antenna is downsized to substantially the same size as an IC tag as described in PTL 1, a radio-wave radiation amount of the antenna is markedly decreased, and it becomes only possible to read the IC tag in an immediate vicinity of the antenna.

In view of the aforementioned problem, the present invention has been achieved, and an object of the present invention is to provide an antenna capable of widening a reading range of an IC tag, including a vicinity of the antenna, and a wiring circuit board and an electronic device including the antenna.

Solution to Problem

According to the present invention, an antenna is provided, in which the antenna including:

a conductor plane;

an island-shaped conductor group including a plurality of island-shaped conductors arranged so as to face the conductor plane via a dielectric medium;

at least one power feeding part that is connected to one of the plurality of island-shaped conductors of the island-shaped conductor group and that transmits power; and a connection part that electrically connects the conductor plane and a first island-shaped conductor that is the island-shaped conductor located on an outermost side of the island-shaped conductor group, wherein each of the plurality of the island-shaped conductors is capacitively connected to another island-shaped conductor or other island-shaped conductors adjacent thereto, the power feeding part is connected to a position other than a center of the island-shaped conductor in an arrangement direction of the island-shaped conductor group, and the connection part is connected to a position inside the first island-shaped conductor by approximately half a width of a second island-shaped conductor, from a portion facing the second island-shaped conductor that is the island-shaped conductor located adjacent to the first island-shaped conductor, out of an edge of the first island-shaped conductor, in the arrangement direction of the island-shaped conductor group.

According to the present invention, a printed circuit board including an antenna is provided, in which the antenna including:

a conductor plane;

an island-shaped conductor group including a plurality of island-shaped conductors arranged so as to face the conductor plane via a dielectric medium;

at least one power feeding part that is connected to one of the plurality of island-shaped conductors of the island-shaped conductor group and that transmits power; and a connection part that electrically connects the conductor plane and a first island-shaped conductor that is the island-shaped conductor located on an outermost side of the island-shaped conductor group, wherein each of the plurality of the island-shaped conductors is capacitively connected to another island-shaped conductor or other island-shaped conductors adjacent thereto, the power feeding part is connected to a position other than a center of the island-shaped conductor in an arrangement direction of the island-shaped conductor group, and the connection part is connected to a position inside the first island-shaped conductor by approximately half a width of a second island-shaped conductor, from a portion facing the second island-shaped conductor that is the island-shaped conductor located adjacent to the first island-shaped conductor, out of an edge of the first island-shaped conductor, in the arrangement direction of the island-shaped conductor group.

According to the present invention, an electronic device including an antenna is provided, in which the antenna including:

a conductor plane;

an island-shaped conductor group including a plurality of island-shaped conductors arranged so as to face the conductor plane via a dielectric medium;

at least one power feeding part that is connected to one of the plurality of island-shaped conductors of the island-shaped conductor group and that transmits power; and a connection part that electrically connects the conductor plane and a first island-shaped conductor that is the island-shaped conductor located on an outermost side of the island-shaped conductor group, wherein each of the plurality of the island-shaped conductors is capacitively connected to another island-shaped conductor or other island-shaped conductors adjacent thereto, the power feeding part is connected to a position other than a center of the island-shaped conductor in an arrangement direction of the island-shaped conductor group, and the connection part is connected to a position inside the first island-shaped conductor by approximately half a width of a second island-shaped conductor, from a portion facing the second island-shaped conductor that is the island-shaped conductor located adjacent to the first island-shaped conductor, out of an edge of the first island-shaped conductor, in the arrangement direction of the island-shaped conductor group.

Advantageous Effects of Invention

According to the present invention, it is possible to read an IC tag over a wide range including a vicinity of an antenna.

BRIEF DESCRIPTION OF DRAWINGS

The above-described object and other objects as well as features and advantages will become further apparent from the following description of preferred exemplary embodiments when taken with the following accompanying drawings.

DESCRIPTION OF EMBODIMENTS

In the following, exemplary embodiments of the present invention will be described with reference to the drawings. In all of the drawings, the same component is assigned with the same reference sign, and description thereof will be omitted as appropriate.

First Exemplary Embodiment

Figure 1:
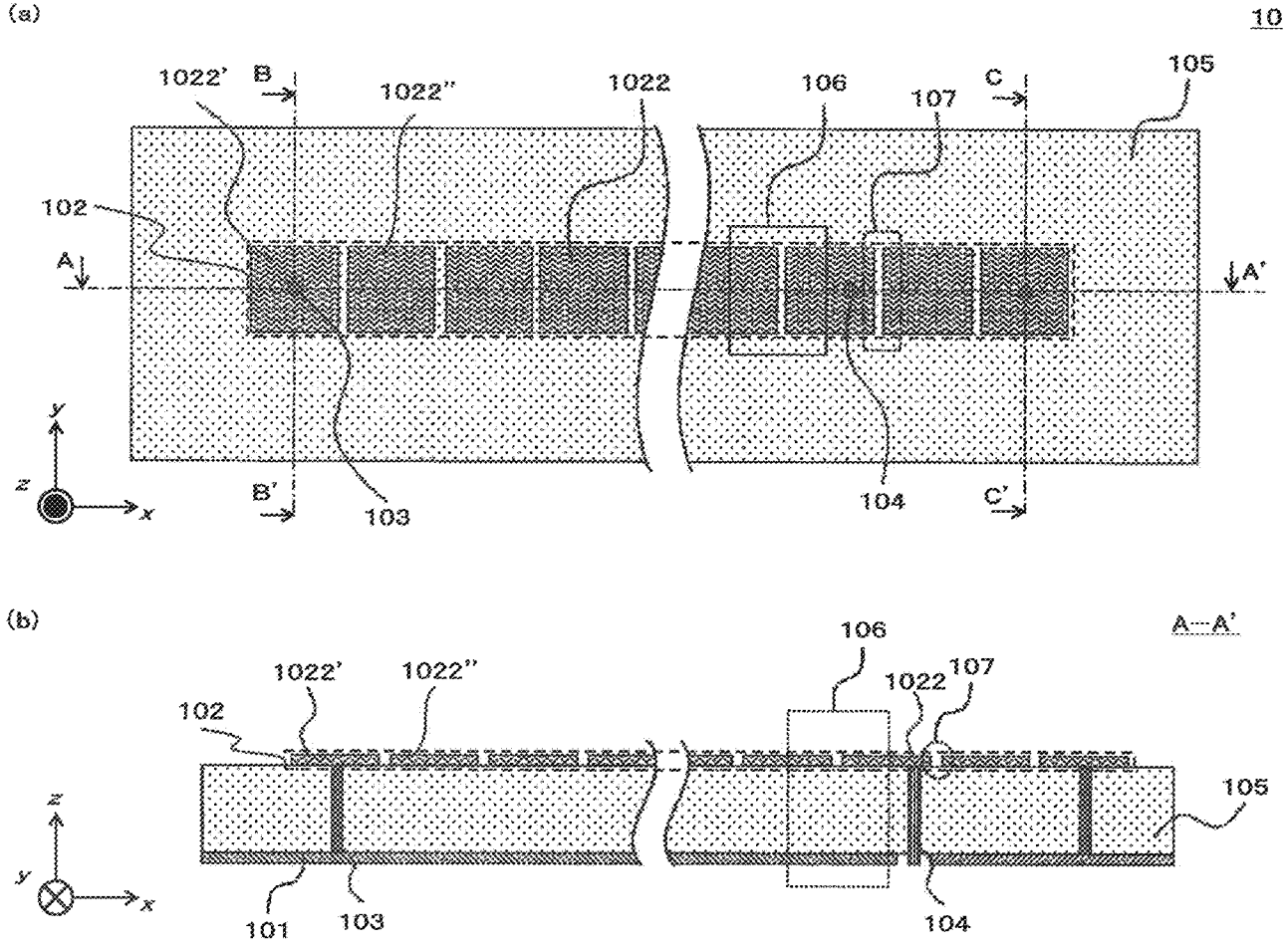
FIG. 1 is a diagram illustrating a configuration example of an antenna 10 in a first exemplary embodiment.

FIG. 1 is a diagram illustrating a configuration example of an antenna 10 in a first exemplary embodiment. FIG. 1(*a*) illustrates a top view of the antenna 10 in the first exemplary embodiment. Further, FIG. 1(*b*) illustrates a cross-sectional view along a line segment A-A' of FIG. 1(*a*). As illustrated in FIG. 1, the antenna 10 of the present exemplary embodiment includes a conductor plane 101, an island-shaped conductor group 102, a conductor via 103, and a power feeding part 104.

The island-shaped conductor group 102 includes a plurality of island-shaped conductors 1022. In the following description, an island-shaped conductor located on an outermost side of the island-shaped conductor group 102 may be expressed as a "first island-shaped conductor 1022'." Further, an island-shaped conductor located adjacent to the first island-shaped conductor 1022' may be expressed as a "second island-shaped conductor 1022"." Further, when it is not specifically necessary to discriminate these conductors from each other, these conductors will be expressed as an "island-shaped conductor 1022". In the present exemplary embodiment, a plurality of island-shaped conductors 1022 are one-dimensionally arranged on a plane facing the conductor plane 101 via a dielectric medium 105. In the present exemplary embodiment, adjacent island-shaped conductors 1022 are capacitively connected by being close to each other and form a capacitance (a capacitance formation part 107) as illustrated in FIG. 1.

Figure 2:
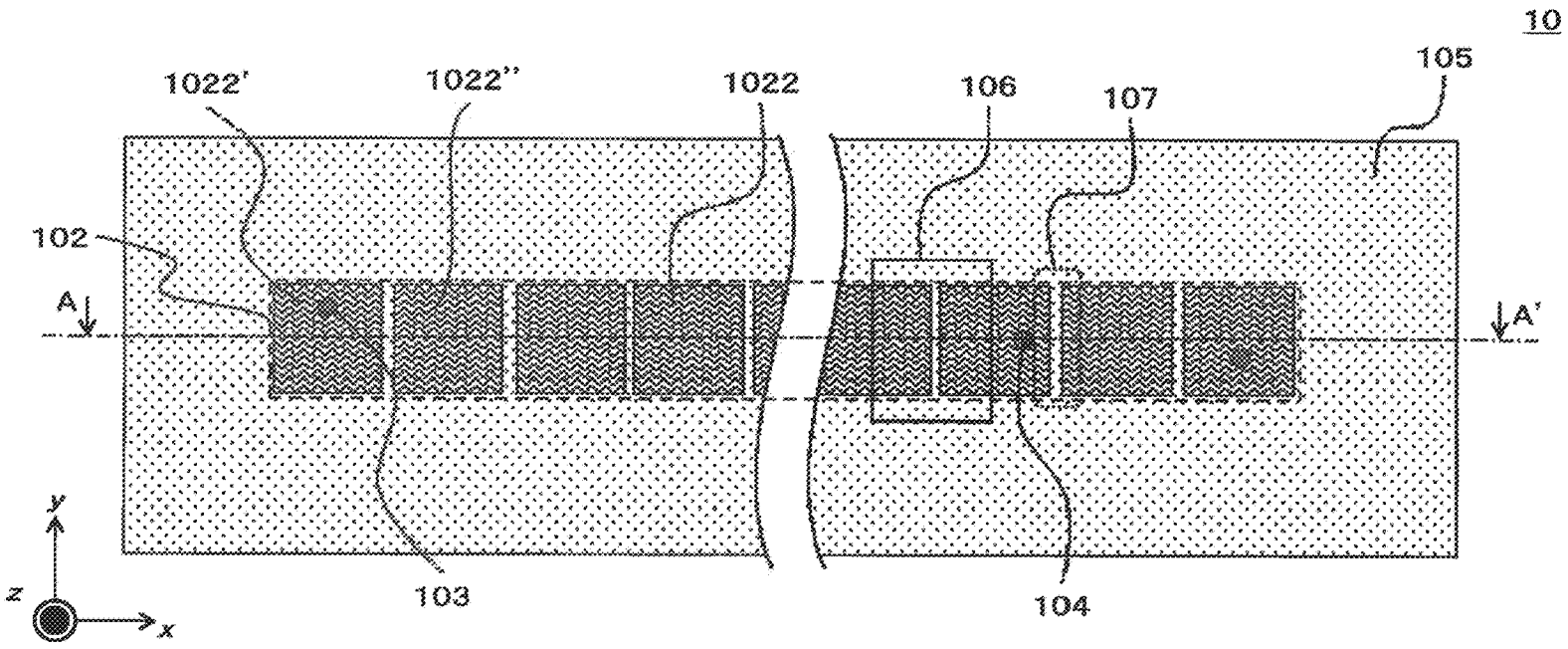
FIG. 2 is a diagram illustrating another configuration example of the antenna 10 in the first exemplary embodiment.

The conductor via 103 electrically connects the conductor plane 101 and the first island-shaped conductor 1022'. Specifically, one end of the conductor via 103 is connected to a vicinity of the center of the first island-shaped conductor 1022' and the other end thereof is connected to the conductor plane 101. "A vicinity of the center" referred to here means a vicinity of the center of the first island-shaped conductor 1022' in an arrangement direction of the island-shaped conductor group 102 as illustrated in a line segment B-B' and a line segment C-C' of FIG. 1(*a*). In other words, as in FIG. 2 illustrating another configuration example of the antenna 10 in the present exemplary embodiment, one end of the conductor via 103 may be connected to the first island-shaped conductor 1022' at a position deviated from a line segment A-A'. Further, a connection position of the conductor via 103 preferably falls within a range of ±20% (preferably ±10%) of a width of the first island-shaped conductor 1022' with respect to the center (the line segment B-B' or the line segment C-C' of FIG. 1(*a*)) of the island-shaped conductor 1022' in the arrangement direction of the island-shaped conductor group 102. The conductor via 103 may be referred to as a connection part.

A unit repeated by including the conductor plane 101 and two adjacent island-shaped conductors 1022 as illustrated in FIG. 1 will be referred to as a unit cell 106. Specifically, the unit cell 106 is configured by including halves of respective island-shaped conductors 1022 and a portion of the conductor plane 101 facing these halves. To reduce an area where a tag cannot be read, it is preferable to reduce a size of the unit cell 106, compared with a size of the tag. Particularly, when an effective wavelength of an electromagnetic wave received and transmitted by the antenna 10 in a medium between the conductor plane 101 and the island-shaped conductor group 102 is designated as $\lambda_0$, a size of the unit cell 106 is preferably smaller than $\lambda_0/2$. In other words, a width of each island-shaped conductor 1022 in the arrangement direction of the island-shaped conductor group 102 is preferably smaller than $\lambda_0/2$. The electromagnetic wave referred to here is an electromagnetic wave of a frequency used in an application, and in a system using, for example, an RFID tag, the 865-868 MHz band, the 902-928 MHz band, or the like that is a UHF band is supposed.

The power feeding part 104 is connected to one island-shaped conductor 1022 of the island-shaped conductor group 102 and feeds power to a transmission line including the conductor plane 101 and the island-shaped conductor 1022. The power feeding part 104 is provided to generate a potential difference between each island-shaped conductor 1022 and the conductor plane 101. Further, the power feeding part 104 is connected to a position other than the center of the island-shaped conductor 1022 in the arrangement direction of the island-shaped conductor group 102. In the example illustrated in FIG. 1, the power feeding part 104 is a conductor via. When power is fed to generate a voltage between the conductor via and the conductor plane 101 that surrounds the conductor via, the power is fed to the antenna 10. Further, in FIG. 1, a case in which the antenna 10 includes one power feeding part 104 is exemplified, but the antenna 10 may include a plurality of power feeding parts 104.

When the antenna 10 according to the present invention is produced using a printed circuit board process, various types of dielectric materials may be used as the dielectric medium 105 between the conductor plane 101 and the island-shaped conductor group 102. Further, when the antenna 10 according to the present invention is produced using a sheet-metal technique, the air may be used as the dielectric medium 105 between the conductor plane 101 and the island-shaped conductor group 102. When a dielectric material is used as the dielectric medium 105, a capacitance value between two adjacent island-shaped conductors 1022 is increased, compared with when air is used as the dielectric medium 105. Therefore, when a dielectric material is used as the dielectric medium 105, the antenna 10 that operates at low frequency can be produced relatively easily.

Figure 3:
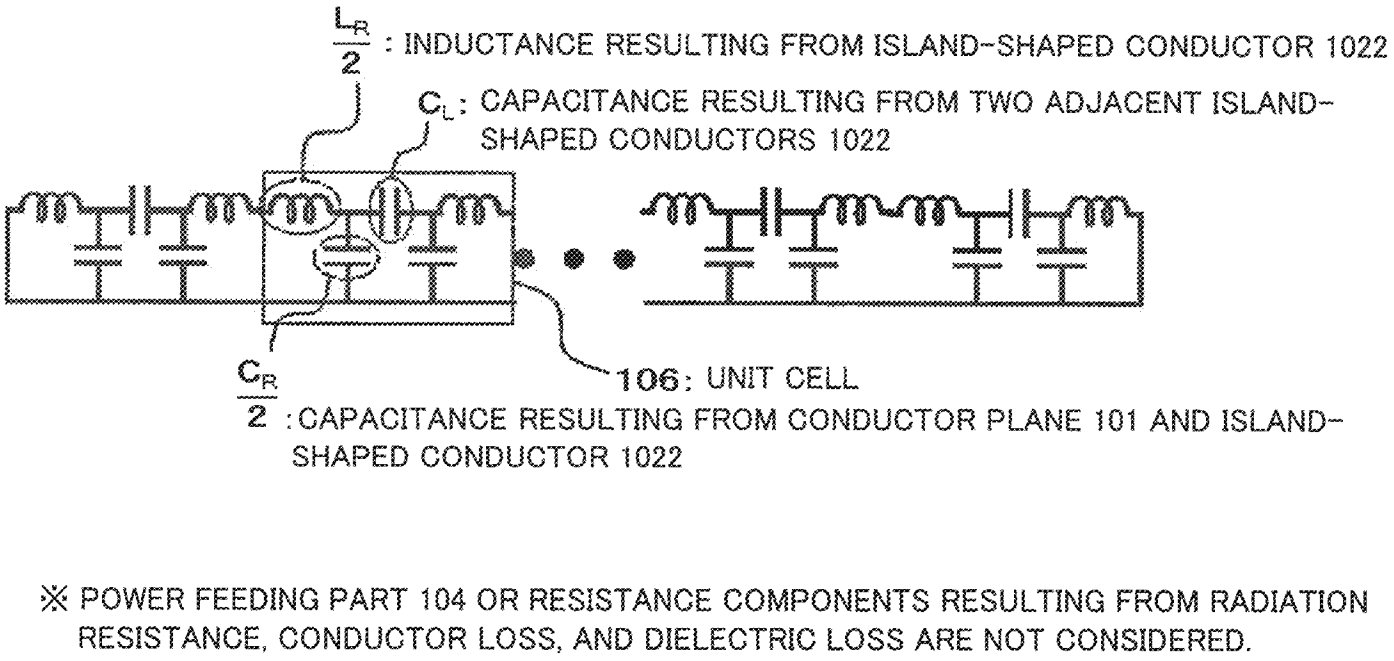
FIG. 3 is an equivalent circuit diagram of the antenna 10 illustrated in FIG. 1.

Next, a basic operating principle of the antenna 10 according to the present exemplary embodiment will be described. FIG. 3 is an equivalent circuit diagram of the antenna 10 illustrated in FIG. 1. However, resistance components resulting from a dielectric loss, a conductor loss, and a radiation loss and the power feeding part 104 are not illustrated in the equivalent circuit of FIG. 3. Hereinafter, a corresponding relation between the equivalent circuit diagram of FIG. 3 and the antenna 10 illustrated in FIG. 1 will be described.

The conductor plane 101 and the island-shaped conductor group 102 disposed to face the conductor plane 101 form a capacitance of a shunt portion of FIG. 3. Further, when two adjacent island-shaped conductors 1022 are close to each other, a capacitance of a series portion of FIG. 3 is formed. A capacitance component of this series portion and inductance components of the island-shaped conductor 1022 and the conductor plane 101 included in the unit cell 106 form a series LC resonator in each unit cell 106. Further, each of the first island-shaped conductors 1022' is connected to the conductor plane 101 via the conductor via 103. Therefore, an equivalent circuit model in which each of the connection points is electrically short-circuited is formed.

Figure 4:
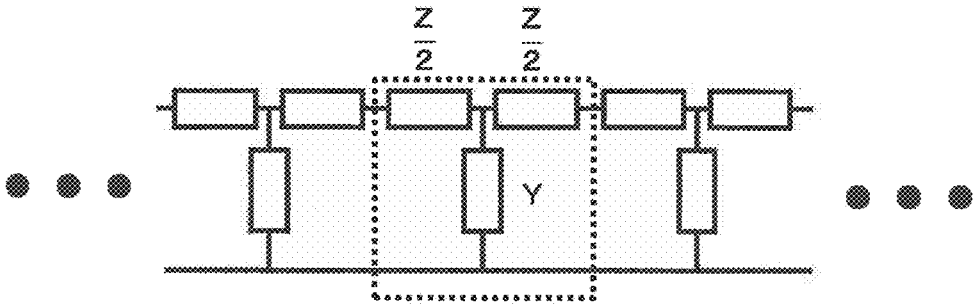
FIG. 4 is an equivalent circuit diagram of a generalized one-dimensional transmission line.

Next, an operation of the equivalent circuit illustrated in FIG. 3 will be described. FIG. 4 is an equivalent circuit diagram of a generalized one-dimensional transmission line. When an electromagnetic wave propagates in an equivalent circuit as in FIG. 4, a voltage wave and a current wave are represented by Formula 1 and Formula 2 described below, respectively, except a time-dependent factor. Further, a propagation coefficient γ in Formula 1 and Formula 2 is represented by Formula 3.

[Equation 1]

$$V=V_0e^{-\gamma x} \quad \text{(Formula 1)}$$

$$I=I_0e^{-\gamma x} \quad \text{(Formula 2)}$$

$$\gamma=\sqrt{ZY} \quad \text{(Formula 3)}$$

V: A voltage wave propagating in a one-dimensional transmission line

I: A current wave propagating in the one-dimensional transmission line $V_0$: An amplitude of the voltage wave propagating in the one-dimensional transmission line $I_0$: An amplitude of the current wave propagating in the one-dimensional transmission line γ: A propagation coefficient of the voltage wave/the current wave propagating in the one-dimensional transmission line Z: A series impedance (per unit cell) of the one-dimensional transmission line Y: A parallel admittance (per unit cell) of the one-dimensional transmission line As can be seen from Formula 1, Formula 2, and Formula 3, when at least one of the series impedance Z or the parallel admittance Y is "0", phase advances of the voltage wave and the current wave having traveled by the width of the unit cell are "0." In other words, at a position where an electromagnetic wave has traveled by the width of the unit cell, these phases are the same. This means that distributions of intensities/phases of an electric field and a magnetic field in a traveling direction of an electromagnetic wave are the same in all of the unit cells 106. (However, intensity distributions are the same in a loss-less case.) In other words, even when there is a position having weak electric field intensity or magnetic field intensity in the unit cell 106, it is possible to cause a position having strong electric field intensity or magnetic field intensity to be always present in an area where an IC tag is present when the unit cell 106 is smaller in size than the IC tag. Therefore, the IC tag can be read with certainty.

Next, when a corresponding relation in the unit cell 106 is considered in FIG. 3 and FIG. 4, the series impedance Z and the parallel admittance Y of the equivalent circuit of FIG. 3 are represented by Formula 4 and Formula 5 described below, respectively.

[Equation 2]

$$Z=j(\omega L_R-1/\omega C_L) \quad \text{(Formula 4)}$$

$$Y=j\omega C_R \quad \text{(Formula 5)}$$

j: An imaginary unit

ω: An angular frequency $L_R$: An inductance (per unit cell) resulting from an island-shaped conductor and a conductor plane $C_L$: A capacitance (per unit cell) between adjacent island-shaped conductors $C_R$: A capacitance (per unit cell) between the island-shaped conductor and the conductor plane As can be seen from Formula 4, in the configuration illustrated as one example in FIG. 1, a series impedance part Z composes a series LC resonance circuit, and at each frequency represented by Formula 6 described below, the condition "Z=0" where a phase advance of an electromagnetic wave is "0" as described above is satisfied.

[Equation 3]

$$\Omega=1/\sqrt{L_R C_L} \quad \text{(Formula 6)}$$

A phenomenon that occurs under the condition where a phase advance of an electromagnetic wave is "0" is known as a zeroth-order resonance phenomenon. In such a case, an electromagnetic wave mode propagating in a transmission line (in the antenna 10 in the present invention) and an electromagnetic wave mode which can be present in a free space satisfy a condition of phase matching. When this condition is satisfied, an electromagnetic wave is efficiently radiated directly above the transmission line (the antenna 10). In other words, the antenna 10 including a configuration as illustrated in FIG. 1 behaves as an antenna having relatively high radiation efficiency.

Figure 5:
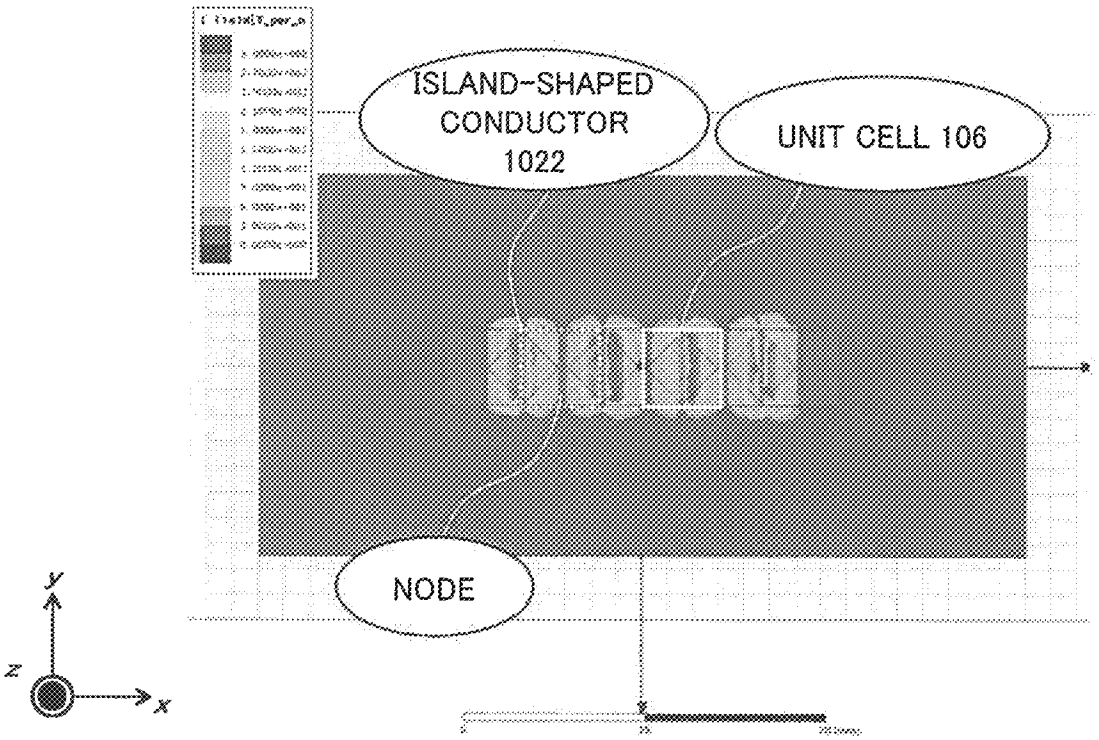
FIG. 5 is a diagram illustrating a result obtained by electromagnetic field analysis executed for the antenna 10 illustrated in FIG. 1.

FIG. 5 is a diagram illustrating a result obtained by electromagnetic field analysis executed for the antenna 10 of FIG. 1. Specifically, FIG. 5 is a diagram illustrating an electric field distribution on the conductor plane 101 at a frequency where a series impedance is "0" (a frequency where a zeroth-order resonance phenomenon occurs). As illustrated in FIG. 5, there is no phase advance at a position separating by the distance of the unit cell 106, and the same radio wave distribution is repeated for each unit cell 106. Further, the center of the island-shaped conductor 1022 in the arrangement direction (an x-axis direction of FIG. 5) of the island-shaped conductor group 102 is a node of electric field intensity. It is necessary to provide the conductor via 103 included in the first island-shaped conductor 1022' to satisfy a condition (boundary condition) in which the center of the first island-shaped conductor 1022' is a node in an end portion of the antenna 10. When there is no conductor via 103, an electromagnetic field mode (zeroth-order resonance mode) having an intensity distribution of an electric field as illustrated in FIG. 5 is not allowed.

Further, as can be seen from FIG. 5, in the first island-shaped conductor 1022', there is no electric field in an outside area with respect to a point where the conductor via 103 is connected. Therefore, a portion of an area of the outside of the conductor via 103 of the first island-shaped conductor 1022' is not necessarily needed. In the configuration illustrated in FIG. 1, portions of the first island-shaped conductor 1022' located on an x-axis negative direction side of the line segment B-B' and an x-axis positive direction side of the line segment C-C' need not be present.

A radiation efficiency of a model of the antenna 10 in the present exemplary embodiment having been subjected to electromagnetic field analysis in FIG. 5 is 15%. When the number and the size of the unit cell 106 are increased in the antenna 10, an area of a radiation surface is increased and then a higher radiation efficiency is obtained.

As described above, in the present exemplary embodiment, the unit cells 106 having approximately the same size or an equal or smaller size compared with an IC tag function as antennas, respectively. Therefore, according to the present exemplary embodiment, of the entire area of the antenna 10, an area where an IC tag is not readable may be reduced. Further, in the present exemplary embodiment, there are a plurality of unit cells 106. Therefore, according to the present exemplary embodiment, an area of a radiation surface is increased, and therefore, a decrease in radiation efficiency can be prevented. In other words, according to the present exemplary embodiment, a reading range of an IC tag including a vicinity of an antenna can be widened.

The antenna 10 may be produced, for example, using a printed circuit board process, integrally with the printed circuit board. Further, the antenna 10 and a printed circuit board including the antenna 10 can be incorporated in an electronic device.

Modified Examples of the First Exemplary Embodiment

Figure 6:
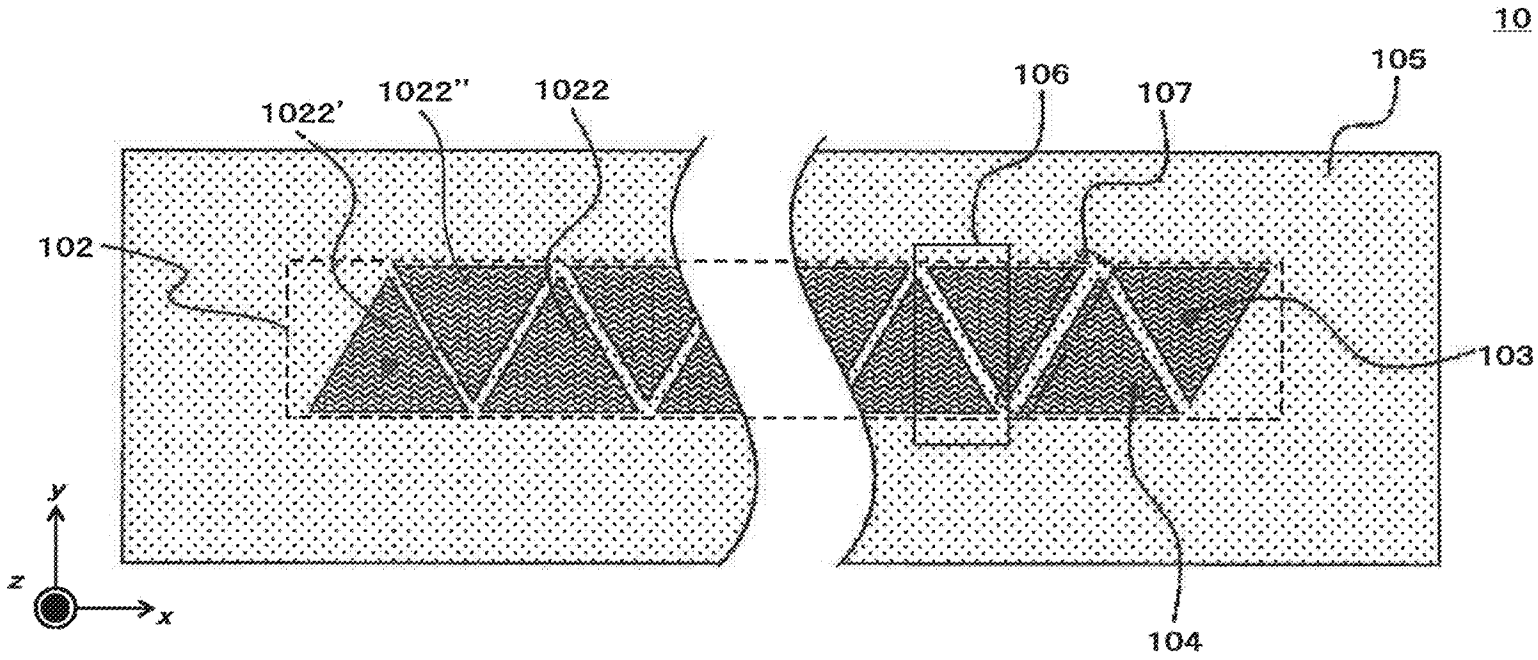
FIG. 6 is a diagram illustrating another example of a shape of an island-shaped conductor 1022.
Figure 7:
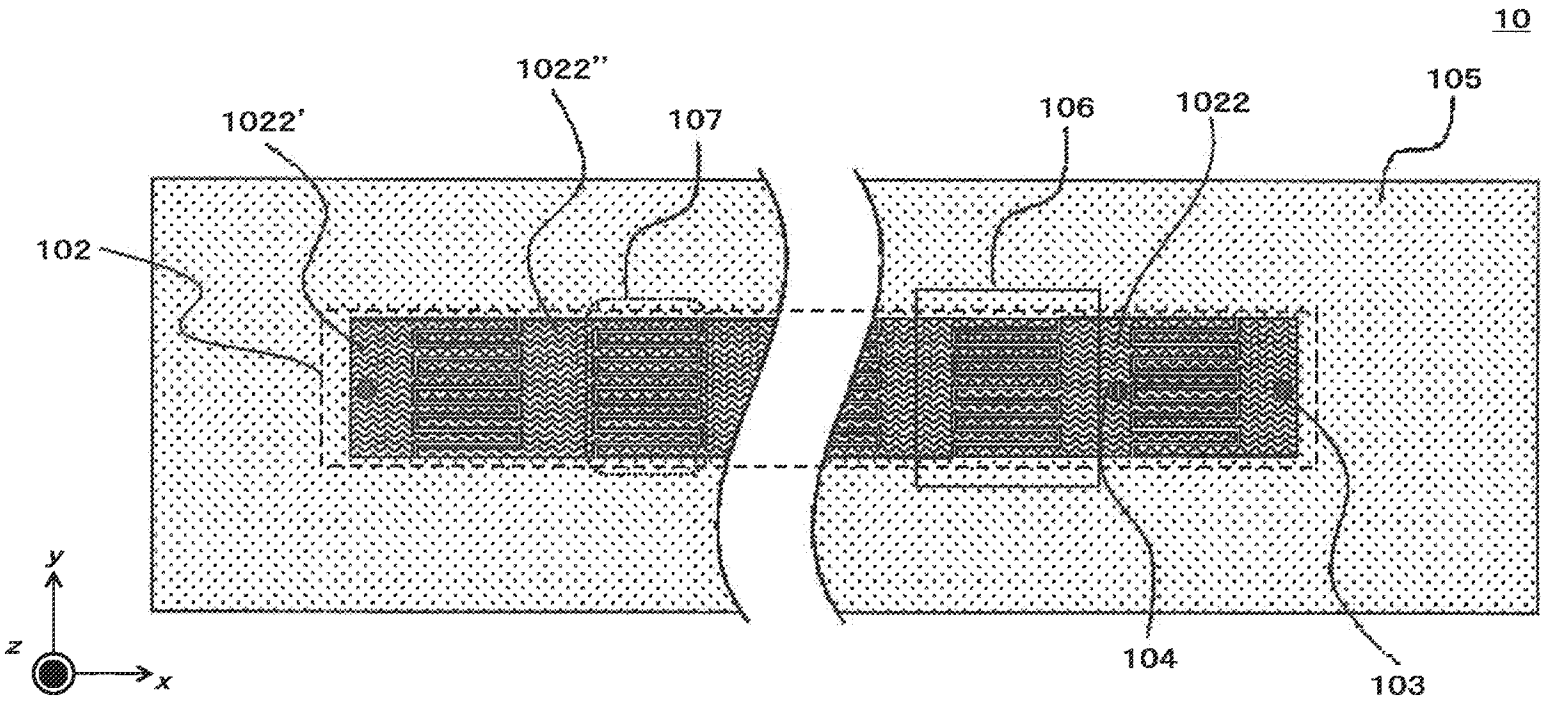
FIG. 7 is a diagram illustrating another example of the shape of the island-shaped conductor 1022.

In the first exemplary embodiment described above, an example in which a shape of the island-shaped conductor 1022 is a square has been illustrated. However, the shape of the inland-shaped conductor 1022 is not limited thereto as in other examples of the shape of the island-shaped conductor 1022 illustrated in FIG. 6 and FIG. 7. The shape of the island-shaped conductor 1022 may be a rectangle, may be a triangle as illustrated in FIG. 6, or may be a polygonal shape other than these, for example. Further, the shape of the island-shaped conductor 1022 may include an interdigital shape as illustrated in FIG. 7. Further, the shape of the island-shaped conductor 1022 may be a shape in which a curved line and a straight line are combined.

Further, in the first exemplary embodiment described above, an example in which all of a plurality of island-shaped conductors 1022 have the same shape has been illustrated. However, all of the plurality of island-shaped conductors 1022 do not necessarily have the same shape, and the island-shaped conductors 1022 having shapes differing from each other may be arranged to configure the antenna 10 of the present exemplary embodiment.

Further, a shape of the first island-shaped conductor 1022' may be different from shapes of other island-shaped conductors 1022. An example in which, for example, as illustrated in FIG. 7, the shape of the first island-shaped conductor 1022' is caused to be half the sizes of the other island-shaped conductors 1022 is easily conceivable. Also in such a case, the above-described advantageous effect is obtainable. Further, in the case that the shape of the first island-shaped conductor 1022' is different from the shapes of the other island-shaped conductors 1022, the connection position of the conductor via 103 may be expressed as follows: The conductor via 103 is connected to a position inside the first island-shaped conductor 1022' by approximately half a width of the second island-shaped conductor 1022" in the arrangement direction of the island-shaped conductor group 102 from a portion facing the second island-shaped conductor 1022" of an edge of the first island-shaped conductor 1022'. The connection position of the conductor via 103 has an allowable range to some extent as expressed as "approximately half a width of the second island-shaped conductor 1022"." It is preferable for the allowable range to be ±20% (preferably ±10%) using the width of the second island-shaped conductor 1022" as a reference.

When a portion facing the second island-shaped conductor 1022" of an edge of the first island-shaped conductor 1022' is used as a reference, a position relation between the first island-shaped conductor 1022' and the conductor via 103 in FIG. 1 is the same as a position relation between the first island-shaped conductor 1022' and the conductor via 103 in FIG. 7. Therefore, the connection position of the conductor via 103 in FIG. 1 can be also expressed as described using FIG. 7.

Figure 8:
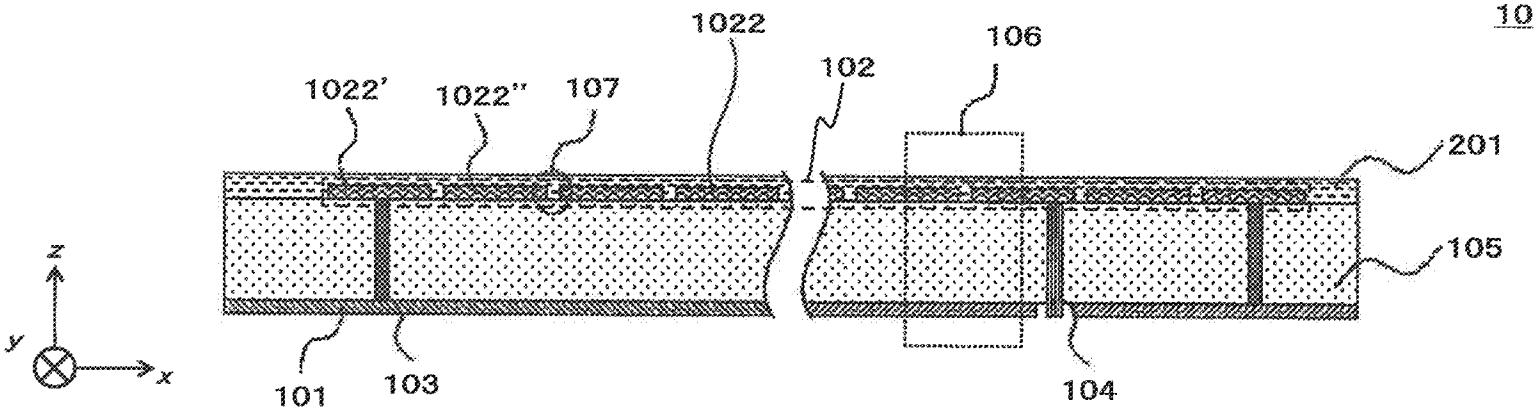
FIG. 8 is a diagram illustrating a configuration of an antenna 10 in a modified example of the first exemplary embodiment.

Further, in the first exemplary embodiment described above, a configuration example in which there is nothing above the island-shaped conductor group 102 has been illustrated. However, as illustrated in FIG. 8, another configuration may be provided above the island-shaped conductor group 102. FIG. 8 is a diagram illustrating a configuration of an antenna 10 in a modified example of the first exemplary embodiment. In FIG. 8, a dielectric material 201 is disposed above the island-shaped conductor group 102. According to such a configuration, a capacitance value between adjacent island-shaped conductors 1022 is increased. A frequency where the antenna 10 operates depends on the capacitance value between adjacent island-shaped conductors 1022 on the basis of Formula 4. Therefore, when the dielectric material 201 is provided above the island-shaped conductor 1022, an antenna that operates at low frequency is obtained even when an area of the unit cell 106 is small. When the dielectric material 201 is used for this purpose, a dielectric substance having high permittivity is preferably used.

By downsizing the unit cell 106, a position dependency of power received by a tag present in a vicinity of the antenna 10 may be reduced.

Figure 9:
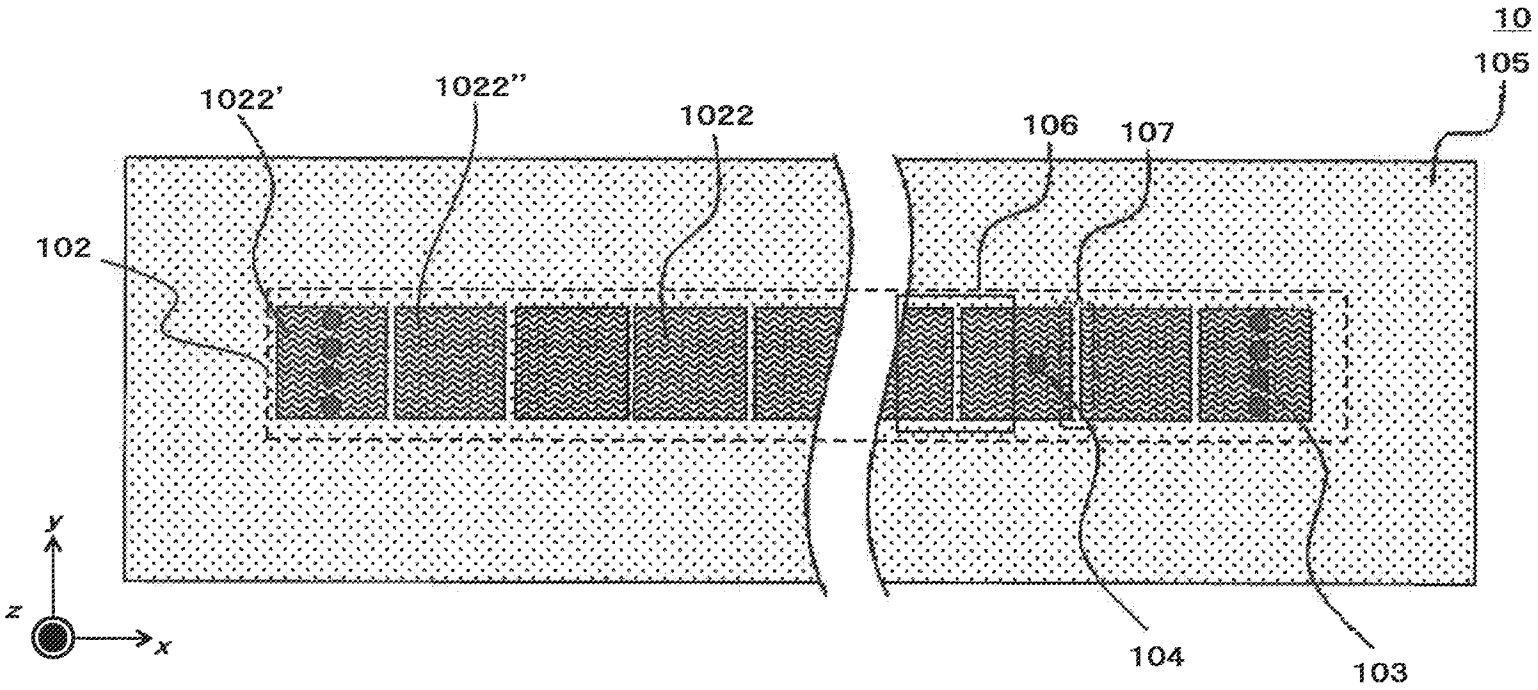
FIG. 9 is a diagram illustrating a configuration of an antenna 10 in a modified example of the first exemplary embodiment.

Further, in the first exemplary embodiment described above, an example in which only one conductor via 103 is connected to the first island-shaped conductor 1022' has been illustrated. However, without limitation thereto, a plurality of conductor vias 103 may be connected to the first island-shaped conductor 1022'. FIG. 9 illustrates a configuration of an antenna 10 in a modified example of the first exemplary embodiment. FIG. 9 is a top view of the antenna 10 in the modified example of the first exemplary embodiment. According to this manner, an inductance value between the island-shaped conductor 1022' located on an outermost side of the island-shaped conductor group 102 and the conductor plane 101 is decreased, compared with when a connection is established using one conductor via 103, and can be made close to a more ideal short circuit state. In other words, a boundary condition of an electromagnetic field mode of a zeroth-order resonance phenomenon occurring in FIG. 5 is more exactly satisfied, and the electromagnetic field mode can be more efficiently excited.

Figure 10:
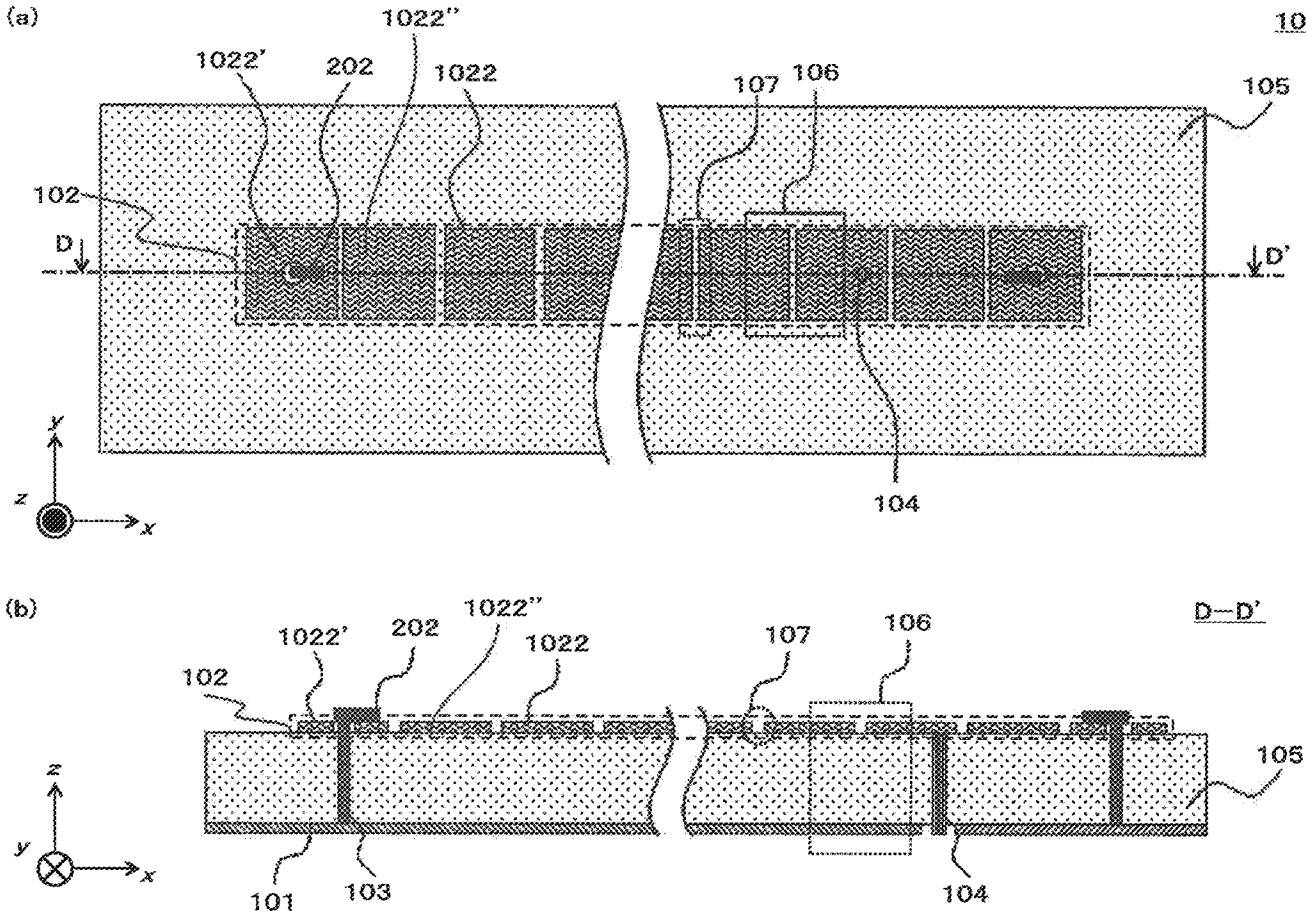
FIG. 10 is a diagram illustrating a configuration of an antenna 10 in a modified example of the first exemplary embodiment.

Further, in the first exemplary embodiment described above, an example in which the first island-shaped conductor 1022' and the conductor plane 101 are physically connected via the conductor via 103 has been illustrated. However, the first island-shaped conductor 1022' and the conductor plane 101 are not necessarily physically connected via the conductor via 103 or the like as long as they are electrically coupled. FIG. 10 illustrates a configuration of an antenna 10 in a modified example of the first exemplary embodiment. As illustrated in FIG. 10, the conductor via 103 is connected to a chip capacitance 202. The conductor via 103 and the chip capacitance 202 configure a part of a series LC resonance circuit. Further, the conductor via 103 is capacitively connected to the first island-shaped conductor 1022' via the chip capacitance 202. FIG. 10(*a*) illustrates a top view of the antenna 10 in the modified example of the first exemplary embodiment. Further, FIG. 10(*b*) illustrates a cross-sectional view along a line segment D-D' of FIG. 10(*a*). In a configuration illustrated as one example in FIG. 10, at a resonance frequency of the series LC resonance circuit including the conductor via 103 and the chip capacitance 202, the conductor plane 101 and the first island-shaped conductor 1022' are ideally short-circuited. When this resonance frequency is matched with a frequency where an electromagnetic field mode (zeroth-order resonance mode) as illustrated in FIG. 5 occurs, the boundary condition of the zeroth-order resonance mode is ideally satisfied. In other words, an electromagnetic field mode as illustrated in FIG. 5 can be more efficiently excited.

Figure 11:
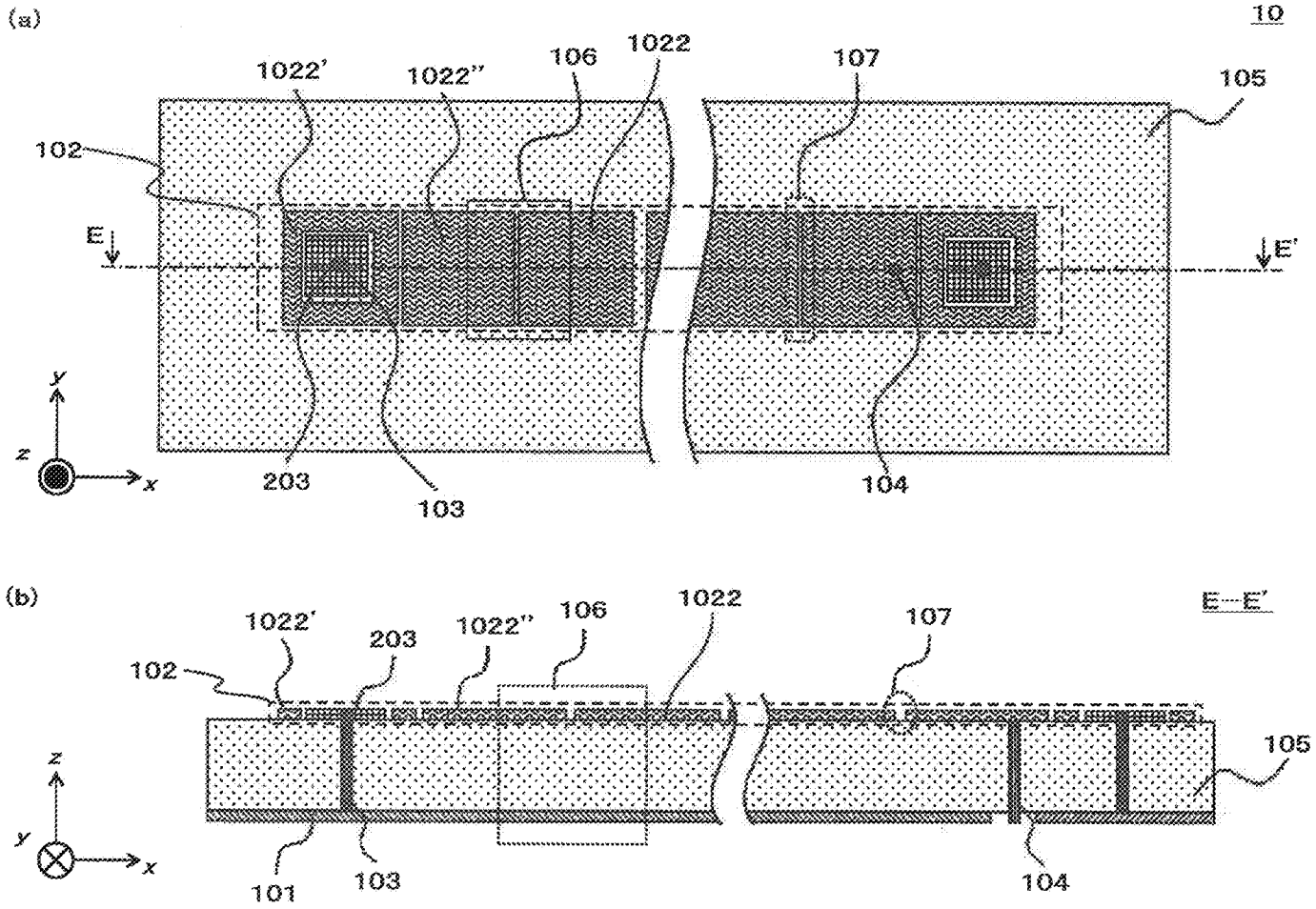
FIG. 11 is a diagram illustrating a configuration of an antenna 10 in a modified example of the first exemplary embodiment.

Further, the chip capacitance 202 of FIG. 10 may be replaced with an island-shaped conductor 203 (a third island-shaped conductor) illustrated in FIG. 11. FIG. 11 is a diagram illustrating a configuration of an antenna 10 in a modified example of the first exemplary embodiment. FIG. 11(*a*) illustrates a top view of the antenna 10 in the modified example of the first exemplary embodiment. Further, FIG. 11(*b*) illustrates a cross-sectional view along a line segment E-E' of FIG. 11(*a*). As illustrated in FIG. 11, the island-shaped conductor 203 is provided in a layer where the island-shaped conductor group 102 is disposed. Further, the island-shaped conductor 203 is disposed close to the first island-shaped conductor 1022' so as to form a capacitance therebetween. The conductor via 103 and the island-shaped conductor 203 are connected to each other. In other words, an inductance component of the conductor via 103 and a capacitance component of the island-shaped conductor 203 configure a series LC resonance circuit between the conductor plane 101 and the first island-shaped conductor 1022'. In this manner, when a capacitance is formed using a conductor pattern, precision problem of a capacitance value resulting from a variation of components of the chip capacitance 202 is reducible.

Figure 12:
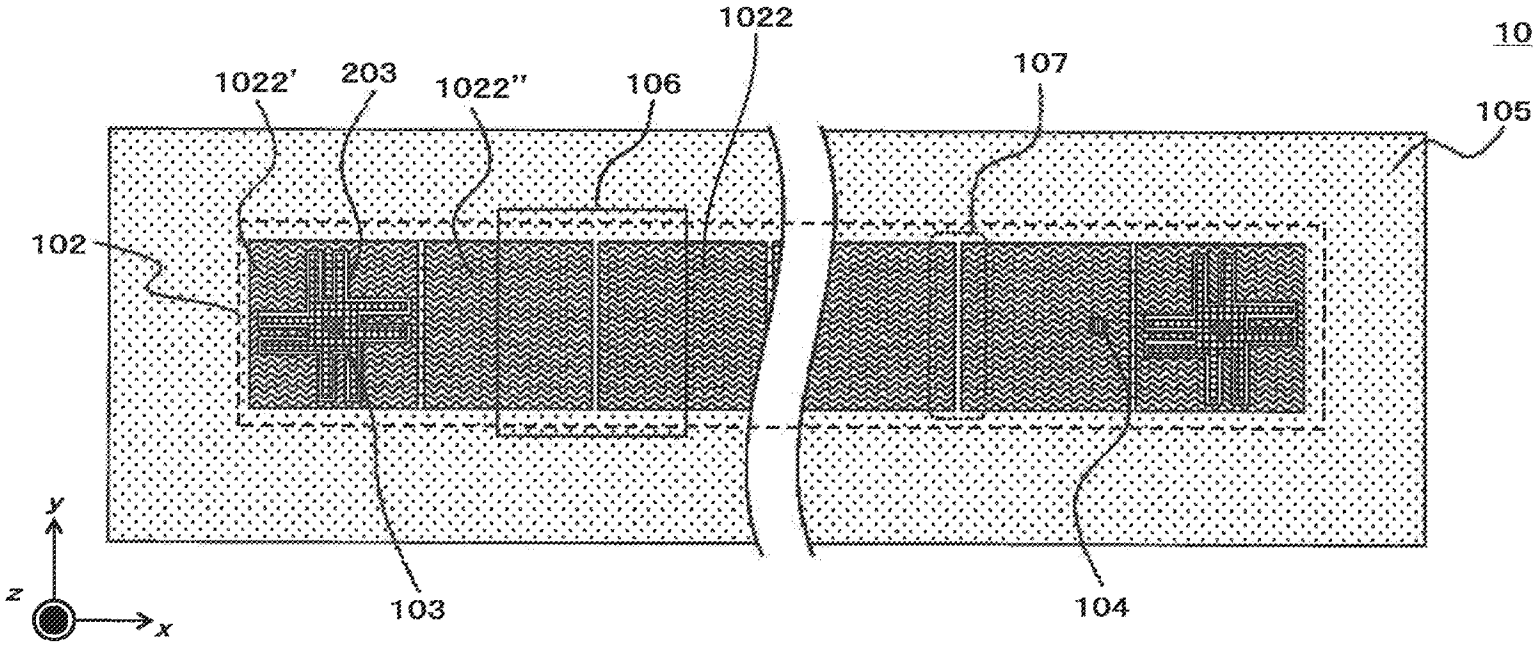
FIG. 12 is a diagram illustrating another example of a shape of an island-shaped conductor 203.

In FIG. 11, an example in which a shape of the island-shaped conductor 203 is a square has been illustrated. However, the shape of the island-shaped conductor 203 may be any shape as long as a capacitance is formed by being close to the first island-shaped conductor 1022'. The shape of the island-shaped conductor 203 may be another polygonal shape such as a triangle, a star, or the like or may be a shape such as a circle or the like, for example. Further, the shape of the island-shaped conductor 203 may be an interdigital shape as illustrated in FIG. 12.

Figure 13:
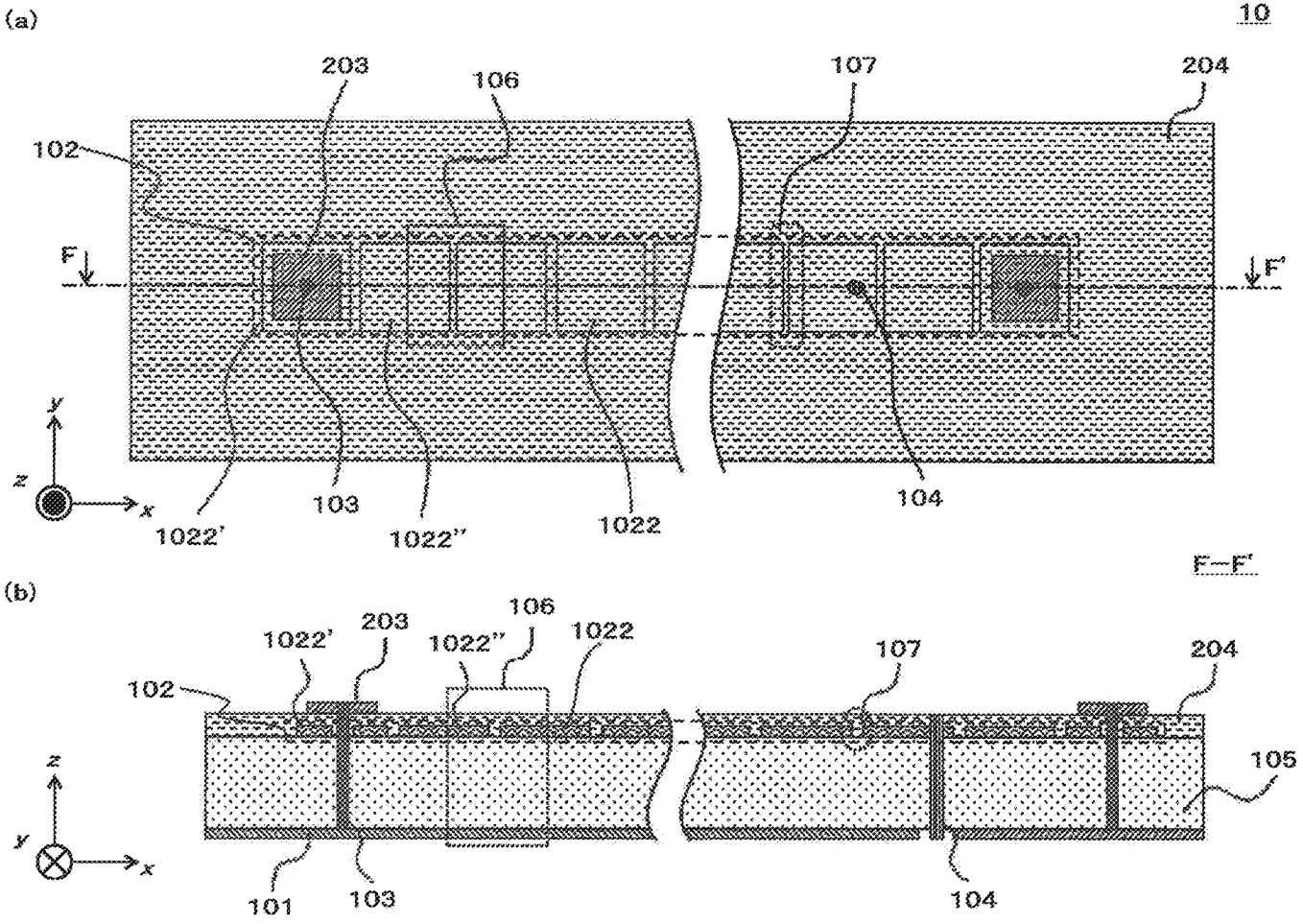
FIG. 13 is a diagram illustrating a configuration of an antenna 10 in a modified example of the first exemplary embodiment.

Further, in FIG. 11, an example in which the island-shaped conductor 203 is disposed in the same layer as the island-shaped conductor group 102 has been illustrated. However, as illustrated in FIG. 13, the island-shaped conductor 203 may be provided in another layer facing a layer where the island-shaped conductor group 102 is disposed. FIG. 13 is a diagram illustrating a configuration of an antenna 10 in a modified example of the first exemplary embodiment. FIG. 13(*a*) illustrates a top view of the antenna 10 in the modified example of the first exemplary embodiment. Further, FIG. 13(*b*) illustrates a cross-sectional view along a line segment F-F' of FIG. 13(*a*). In FIG. 12, the island-shaped conductor 203 forms a capacitance by facing the first island-shaped conductor 1022'. The conductor via 103 and the island-shaped conductor 203 are connected to each other. In other words, an inductance component of the conductor via 103 and a capacitance component of the island-shaped conductor 203 configure a series LC resonance circuit between the conductor plane 101 and the first island-shaped conductor 1022'. When a capacitance is formed using a conductor pattern in this manner, precision problem of a capacitance value resulting from a variation of components that may occur in the chip capacitance 202 is reducible in the same manner as in the example of FIG. 11. Further, as illustrated in FIG. 13, when a capacitance is formed in such a manner that the island-shaped conductor 203 faces the first island-shaped conductor 1022', a large capacitance value is easily obtainable with a small area. Therefore, even when an area that the unit cell 106 occupies in the xy plane is small, the conductor plane 101 and the first island-shaped conductor 1022' can be ideally short-circuited using such a series LC resonance circuit.

Figure 14:
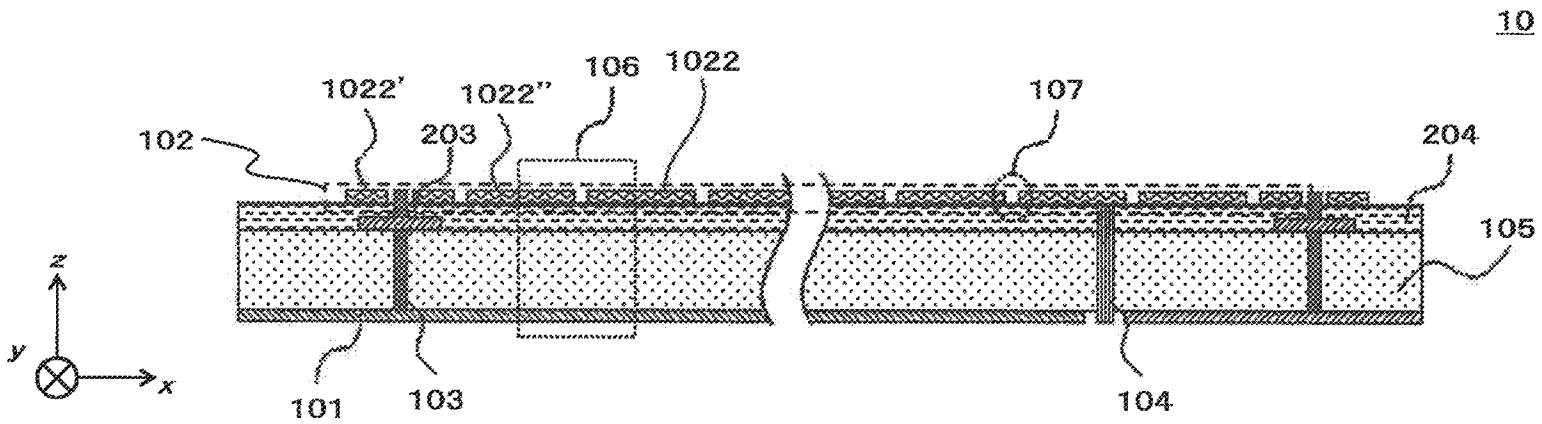
FIG. 14 is a diagram illustrating a configuration of an antenna 10 in a modified example of the first exemplary embodiment.

In FIG. 13, a configuration in which the island-shaped conductor 203 is provided above a layer where the island-shaped conductor group 102 is disposed has been illustrated. However, the island-shaped conductor 203 may be provided under a layer where the island-shaped conductor group 102 is disposed as illustrated in FIG. 14. FIG. 14 is a diagram illustrating a configuration of an antenna 10 in a modified example of the first exemplary embodiment. In FIG. 14, the island-shaped conductor 203 is provided between a layer where the island-shaped conductor group 102 is disposed and a layer where the dielectric medium 105 is disposed. Even in such a manner, the same advantageous effect as in the case of FIG. 13 is obtainable.

Further, in FIG. 13 and FIG. 14, examples in which a shape of the island-shaped conductor 203 is a square have been illustrated. However, the shape of the island-shaped conductor 203 may be any shape as long as a capacitance is formed between the island-shaped conductor 203 and the first island-shaped conductor 1022'. The shape of the island-shaped conductor 203 may be another polygonal shape such as a triangle, a star, or the like or may be a shape such as a circle or the like, for example.

Further, when the configuration of FIG. 13 is realized using a printed circuit board process, a dielectric material 204 is supposed to be disposed in a space sandwiched by the first island-shaped conductor 1022' and the island-shaped conductor 203. Even in this case, in the same manner as in the example illustrated in FIG. 8, a dielectric substance having high permittivity is preferably used as the dielectric material 204.

Figure 15:
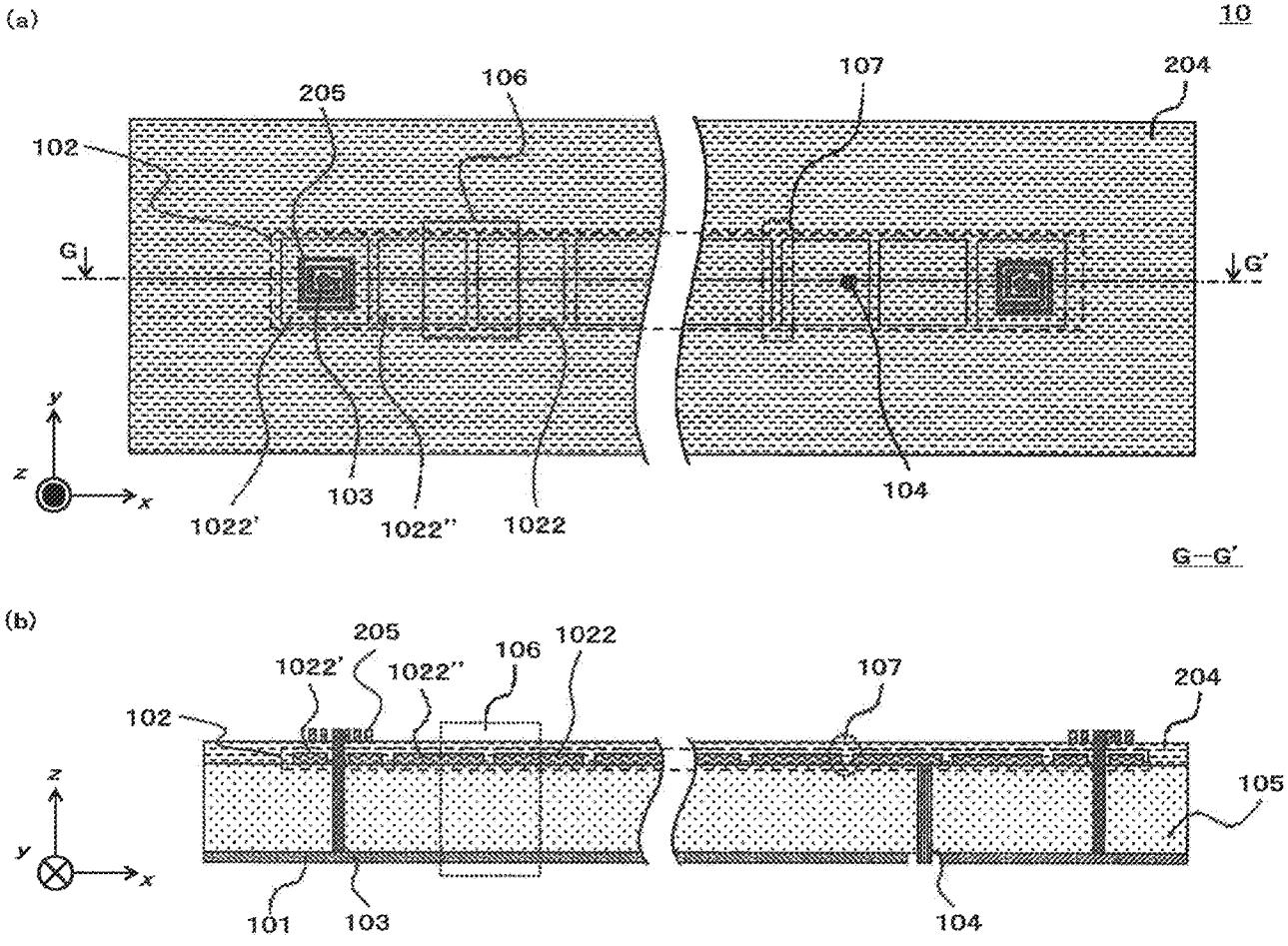
FIG. 15 is a diagram illustrating a configuration of an antenna 10 in a modified example of the first exemplary embodiment.

Further, as illustrated in FIG. 15, the island-shaped conductor 203 illustrated as the examples in FIG. 13 and FIG. 14 may be replaced with a transmission line. FIG. 15 is a diagram illustrating a configuration of an antenna 10 in a modified example of the first exemplary embodiment. FIG. 15(*a*) illustrates a top view of the antenna 10 in the modified example of the first exemplary embodiment. Further, FIG. 15(*b*) illustrates a cross-sectional view along a line segment G-G' of FIG. 15(*a*). The transmission line illustrated in FIG. 15 is a transmission line (an open stub 205) in which one end thereof is an open end. The open stub 205 faces the first island-shaped conductor 1022' as illustrated in FIG. 15 and behaves as a transmission line in which the first island-shaped conductor 1022' is used as a return path. Further, the one end of the open stub 205 is connected to the conductor via 103. The open stub 205 electrically short-circuits the conductor via 103 and the first island-shaped conductor 1022' at a frequency where a stub length is equal to $\lambda/(4\times(2k-1))$ when $\lambda$ is designated as an effective wavelength of an electromagnetic wave transmitted in the open stub 205 and k is designated as a natural number. Therefore, the boundary condition of the electromagnetic field mode (zeroth-order resonance mode) illustrated in FIG. 6 can be ideally satisfied. Further, when the open stub 205 is used as illustrated in FIG. 15, mounting is executable on a smaller area in an xy plane, compared with the configuration illustrated in FIG. 13.

Figure 16:
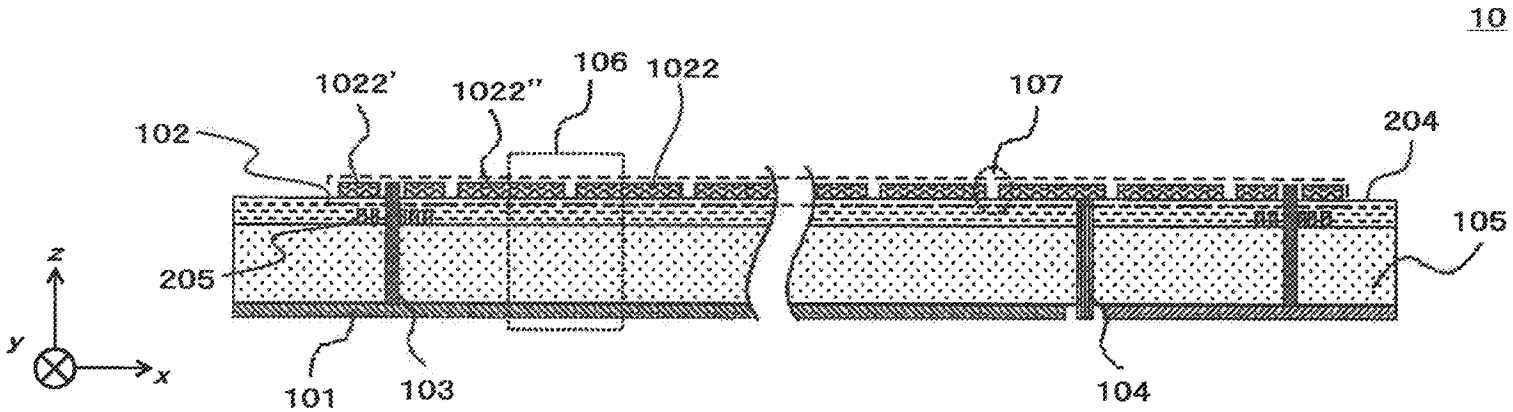
FIG. 16 is a diagram illustrating a configuration of an antenna 10 in a modified example of the first exemplary embodiment.

In FIG. 15, a configuration in which the open stub 205 is provided above a layer where the island-shaped conductor group 102 is disposed has been illustrated. However, the open stub 205 may be provided under a layer where the island-shaped conductor group 102 is disposed as illustrated in FIG. 16. FIG. 16 is a diagram illustrating a configuration of an antenna 10 in a modified example of the first exemplary embodiment. In FIG. 16, the open stub 205 is provided between a layer where the island-shaped conductor group 102 is disposed and a layer where the dielectric medium 105 is disposed. Even in this manner, the same advantageous effect as in the case of FIG. 15 is obtainable.

Further, in FIG. 15, a configuration in which the open stub 205 is disposed above a spiral has been illustrated. However, the open stub 205 may have any shape when functioning as a transmission line in which the first island-shaped conductor 1022' is used as a return path. The open stub 205 may be meandering or linear or may have another irregular shape, for example.

Further, when the configuration of FIG. 15 is realized using a printed circuit board process, the dielectric material 204 is supposed to be disposed in a space sandwiched by the first island-shaped conductor 1022' and the open stub 205.

Even in this case, in the same manner as in the example illustrated in FIG. 8, a dielectric substance having high permittivity is preferably used as the dielectric material 204.

Figure 17:
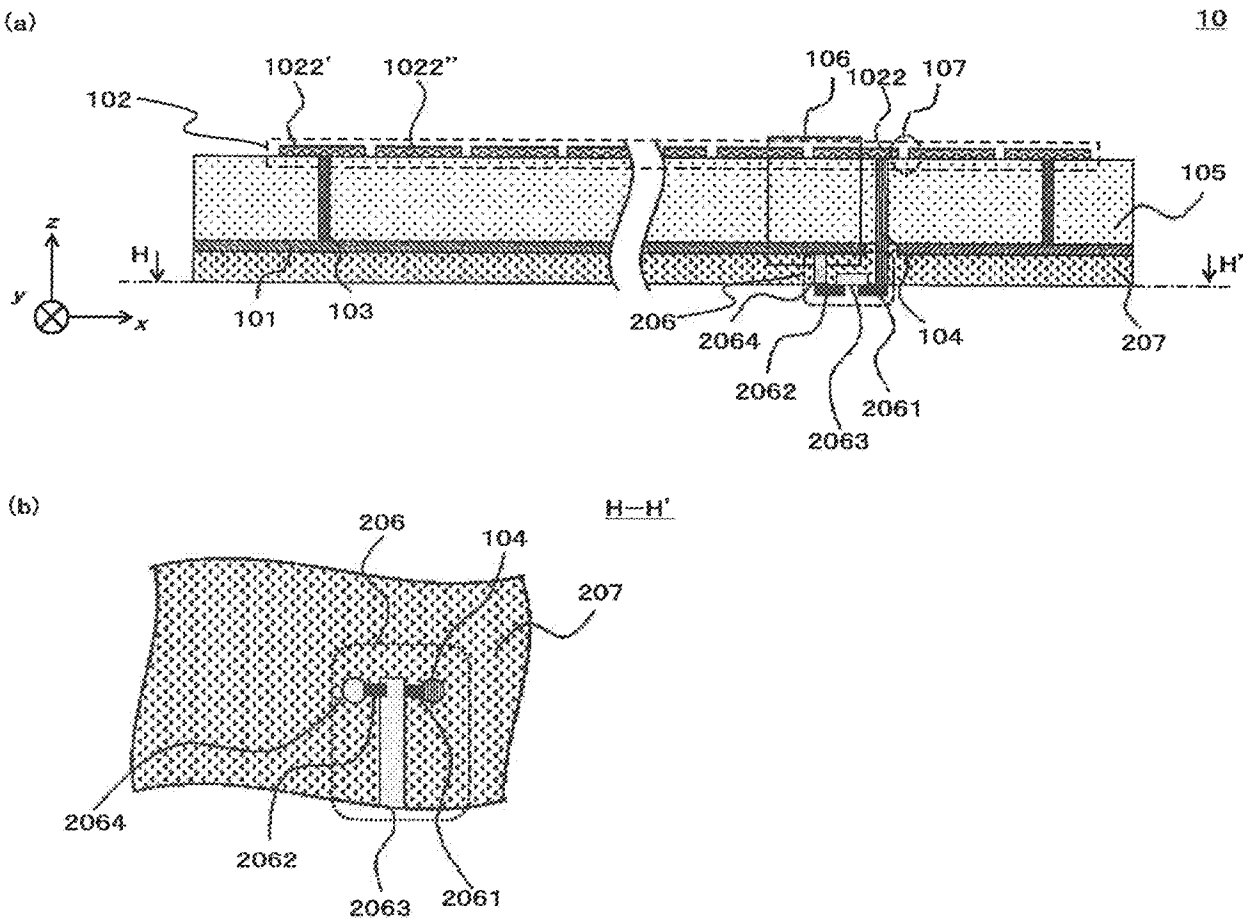
FIG. 17 is a diagram illustrating a configuration example of a matching circuit 206.

Further, the antenna 10 may include an accessary circuit similar to that of a general antenna device. As illustrated in FIG. 17, the antenna 10 may include, for example, a matching circuit 206 for impedance matching. FIG. 17 is a diagram illustrating a configuration example of the matching circuit 206. FIG. 17(*a*) is a cross-sectional view of the antenna 10 in the first exemplary embodiment applied with the matching circuit 206. Further, FIG. 17(*b*) is a cross-sectional view of a periphery of the matching circuit 206 along a line segment H-H' cross-section of FIG. 17(*a*).

In the configuration illustrated in FIG. 17, a dielectric layer 207 is laminated on the lower side of the conductor plane 101, and the matching circuit 206 is disposed on the lower surface of the dielectric layer 207. Specifically, the matching circuit 206 includes chip components 2061 and 2062, a power feeding line 2063, and a conductor via 2064. The chip components 2061 and 2062 are chip capacitors or chip inductors. As illustrated in FIG. 17, one end of the conductor via 2064 is connected to the conductor plane 101, and the other end thereof is exposed to the lower surface of the dielectric layer 207. Further, one end of the chip component 2061 is connected to the power feeding part 104, and the other end thereof is connected to the power feeding line 2063. Further, one end of the chip component 2062 is connected to the power feeding line 2063, and the other end thereof is connected to the conductor via 2064. In other words, the chip component 2061 connects the power feeding line 2063 and the power feeding part 104 in series, and the chip component 2062 connects the power feeding line 2063 and the conductor plane 101 in a shunt manner via the conductor via 2064. In the configuration illustrated in FIG. 17, an electromagnetic wave having propagated in a transmission path including the conductor plane 101 and the power feeding line 2063 is introduced to the antenna 10.

Figure 18:
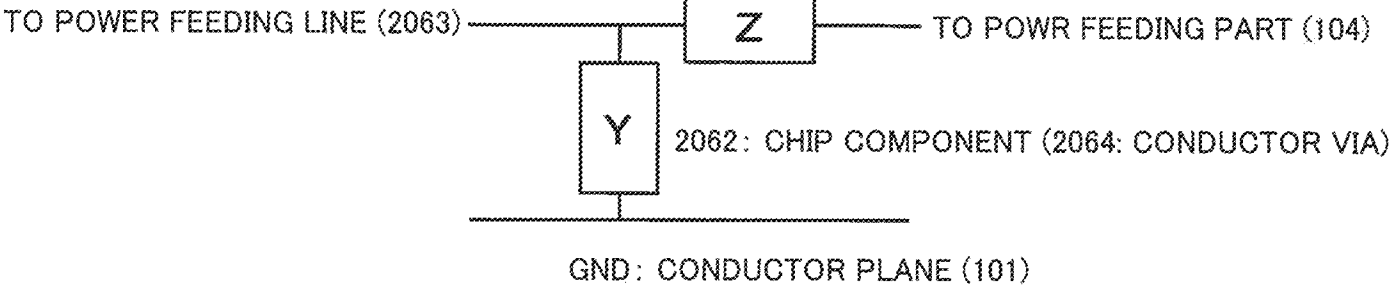
FIG. 18 is a diagram illustrating an equivalent circuit model of the matching circuit 206 illustrated in FIG. 17.

FIG. 18 is a diagram illustrating an equivalent circuit model of the matching circuit 206 illustrated in FIG. 17. In FIG. 18, Z is equivalent to the chip component 2061, and Y is equivalent to the chip component 2062. However, when an inductance of the conductor via 2064 is not neglected in FIG. 18, it is assumed that the conductor via 2064 is also included in Y. As illustrated in FIG. 18, Z and Y configure an L-shaped matching circuit, and thereby impedances are matched.

Figure 19:
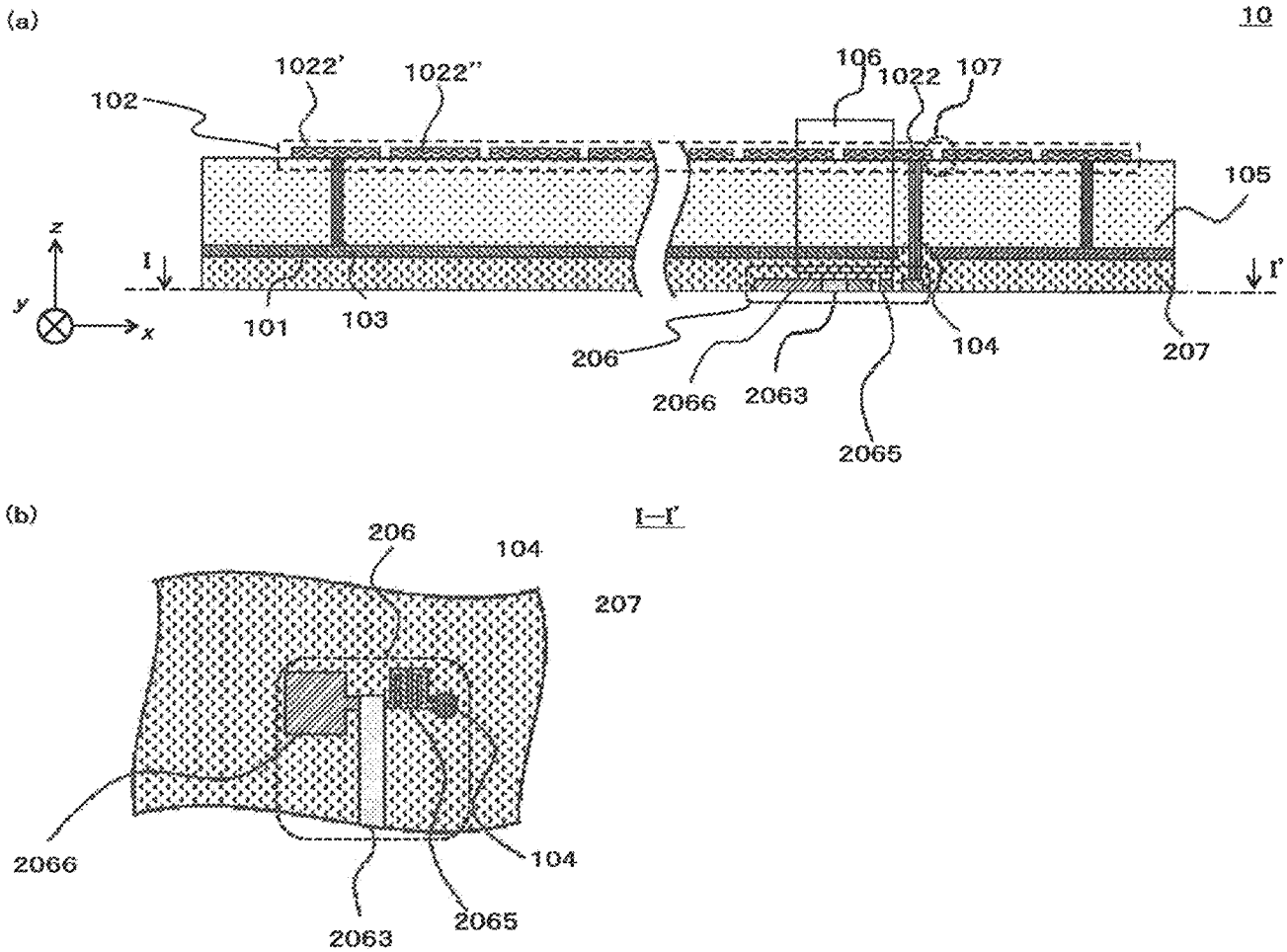
FIG. 19 is a diagram illustrating another configuration example of the matching circuit 206.

FIG. 19 is a diagram illustrating another configuration example of the matching circuit 206. FIG. 19(*a*) is a cross-sectional view of the antenna 10 of the first exemplary embodiment applied with the matching circuit 206. Further, FIG. 19(*b*) is a cross-sectional view of a periphery of the matching circuit 206 along a line segment I-I' cross-section of FIG. 19(*a*). In the configuration illustrated in FIG. 19, a conductor wiring 2065 configuring an inductance is disposed instead of the chip component 2061 of FIG. 17, and an island-shaped conductor 2066 configuring a capacitance is disposed instead of the chip component 2062 and the conductor via 2064 of FIG. 17.

In FIG. 17 and FIG. 19, examples of a matching circuit have been illustrated, but a configuration of the matching circuit is not limited thereto. A configuration of a matching circuit generally used for an antenna may be used for the antenna 10 according to the present invention. With respect to a configuration of an equivalent circuit, not only the configuration illustrated in FIG. 18, but also a configuration in which Z and Y are switched to each other, a configuration in which into a power feeding line, a transmission line of a line length of $\lambda/4$ having an impedance different from that of the former is inserted, a configuration in which a position of attaching a matching circuit to a power feeding line is devised, a configuration in which a stub is used instead of an inductance or a capacitance, or the like can be conceived. Further, in the configuration illustrated in FIG. 18, one end of Y is connected between the power feeding part 2063 and the chip component 2061, but a configuration in which one end of Y is connected between Z and the power feeding part 104 is also conceivable. It goes without saying that in methods for realizing such equivalent circuits, there are a wide variety of methods including a method of using only chip components as in FIG. 17, a method of using a conductor pattern and an island-shaped conductor as illustrated in FIG. 19, and a method in which both are combined. Further, a member for impedance matching included in the matching circuit 206 is not specifically limited when providing a capacitance component or an inductance component.

Second Exemplary Embodiment

The present exemplary embodiment is the same as the first exemplary embodiment except for the following points.

Figure 20:
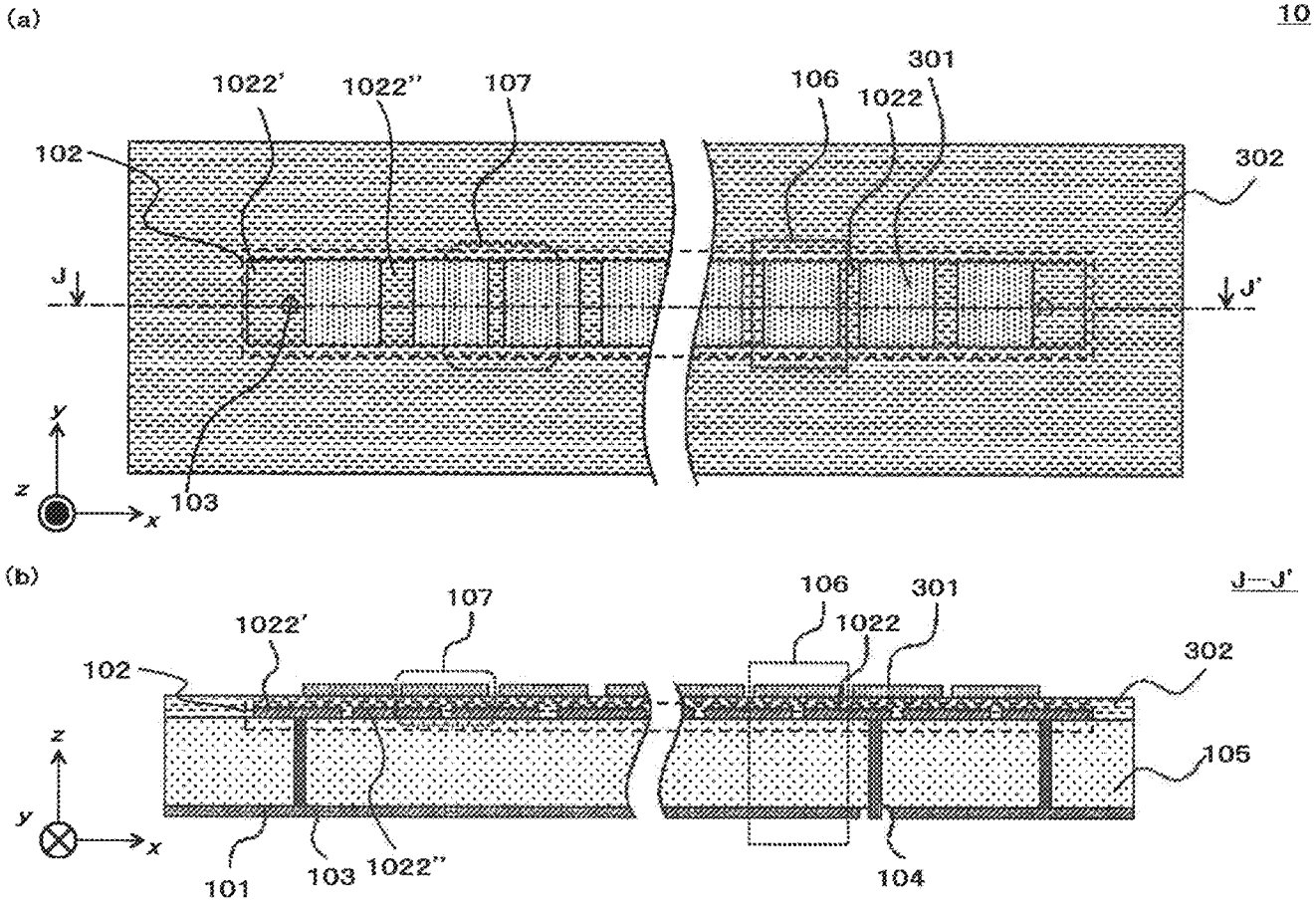
FIG. 20 is a diagram illustrating a configuration example of an antenna 10 in a second exemplary embodiment.

FIG. 20 is a diagram illustrating a configuration example of an antenna 10 in a second exemplary embodiment. FIG. 20(*a*) illustrates a top view of the antenna 10 in the second exemplary embodiment. Further, FIG. 20(*b*) illustrates a cross-sectional view along a line segment J-J' of FIG. 20(*a*). As illustrated in FIG. 20, the antenna 10 of the present exemplary embodiment further includes a plurality of auxiliary conductors 301.

The plurality of auxiliary conductors 301 of the present exemplary embodiment is disposed in a layer above the island-shaped conductor group 102 with a dielectric medium 302 therebetween. Each of the plurality of auxiliary conductors 301 is disposed so as to partially overlap with each pair of two adjacent island-shaped conductors 1022, respectively, in planar view. Each auxiliary conductor 301 forms a capacitance together with both of the two island-shaped conductors 1022 present at a facing position via the dielectric medium 302. In other words, the two adjacent island-shaped conductors 1022 are capacitively connected via the auxiliary conductor 301.

A substance of the dielectric medium 302 is not specifically limited. When, for example, the antenna 10 is produced using a printed circuit board process, the dielectric medium 302 is supposed to be various types of dielectric materials. Further, when the antenna 10 is produced using a sheet-metal technique, the dielectric medium 302 is supposed to be air.

Further, in FIG. 20, an example in which a shape of the auxiliary conductor 301 is a square has been illustrated. However, the shape of the auxiliary conductor 301 is not limited thereto. The shape of the auxiliary conductor 301 may be a polygonal shape such as a rhombus, a star, or the like or may be a shape such as a circle or an ellipse, for example.

Further, in FIG. 20, as the conductor via 103, a non-through via is used, but the conductor via 103 may be a through via. In this case, a clearance is preferably provided for the auxiliary conductor 301 so that the auxiliary conductor 301 and the conductor via 103 are not electrically connected.

In the antenna 10 in the present exemplary embodiment, a capacitance value between two adjacent island-shaped conductors 1022 mainly depends on an area where the auxiliary conductor 301 and the two adjacent island-shaped conductors 1022 overlap with each other and a distance in a thickness direction (a z-axis direction in FIG. 20(*a*)) between the auxiliary conductor 301 and the two adjacent island-shaped conductors 1022. Therefore, in the present exemplary embodiment, the capacitance value between two adjacent island-shaped conductors 1022 can be easily increased, compared with the configuration in which two adjacent island-shaped conductors 1022 directly form a capacitance. Further, according to Formula 4 or Formula 6 described above, an operating frequency of the antenna 10 of the present invention is determined by a capacitance between two adjacent island-shaped conductors 1022 and inductances of the island-shaped conductor 1022 and the conductor plane 101. In the antenna 10 of the present exemplary embodiment, on the basis of a position relation between a plurality of auxiliary conductors 301 and a plurality of island-shaped conductors 1022, the capacitance between two adjacent island-shaped conductors 1022 can be easily increased. Therefore, according to the present exemplary embodiment, an antenna in which an area of the unit cell 106 is small can be realized while operating at low frequency. In other words, an antenna in which even in a vicinity of the antenna, a spacial position dependency of a power reception intensity of an IC tag is small may be realized.

Further, in the antenna 10 of the present exemplary embodiment, an electric field that occurs in a capacitance between two adjacent island-shaped conductors 1022 occurs in a space between the two adjacent island-shaped conductors 1022 and the auxiliary conductor 301. Therefore, when an IC tag comes close to an upper portion of the antenna 10, a variation of a capacitance value between the two adjacent island-shaped conductors 1022 decreases. In other words, the present exemplary embodiment may reduce an influence of the IC tag on the antenna 10, when the IC tag comes close to an upper portion of the antenna 10.

Figure 21:
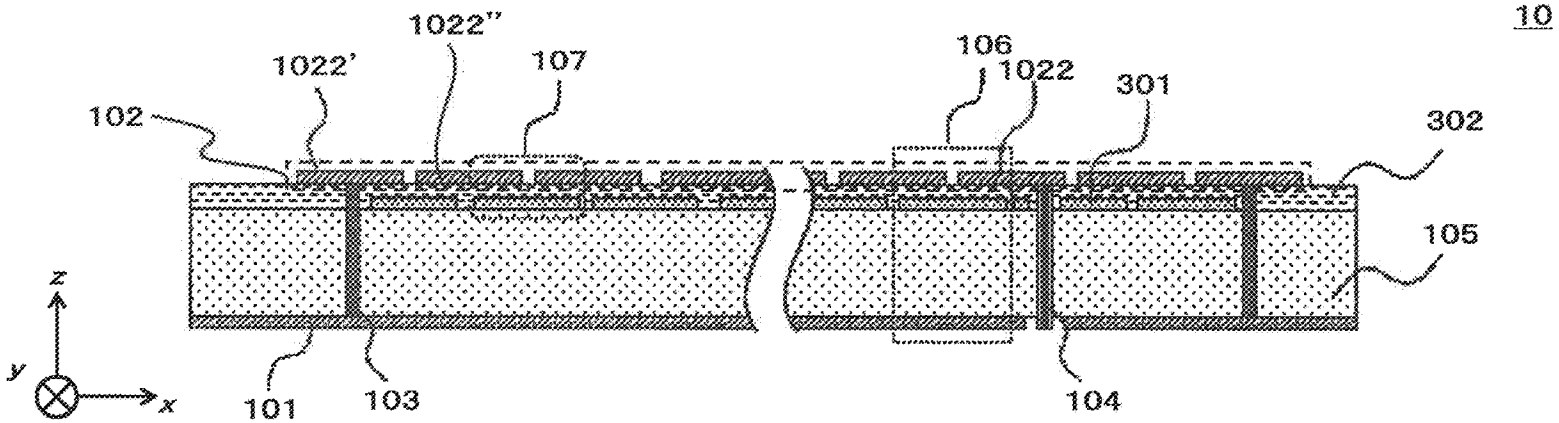
FIG. 21 is a diagram illustrating another configuration example of the antenna 10 in the second exemplary embodiment.

Further, in FIG. 20, an example in which a plurality of auxiliary conductors 301 are disposed in a layer above the island-shaped conductor group 102 has been illustrated, but a disposition position of the plurality of auxiliary conductors 301 is not limited thereto. As illustrated in FIG. 21, a plurality of auxiliary conductors 301 may be disposed, for example, in a layer below the island-shaped conductor group 102. FIG. 21 is a diagram illustrating another configuration example of the antenna 10 in the second exemplary embodiment. Even in such a configuration, the above-described advantageous effect of the present exemplary embodiment is obtainable.

Third Exemplary Embodiment

The present exemplary embodiment is the same as the second exemplary embodiment except for the following points.

Figure 22:
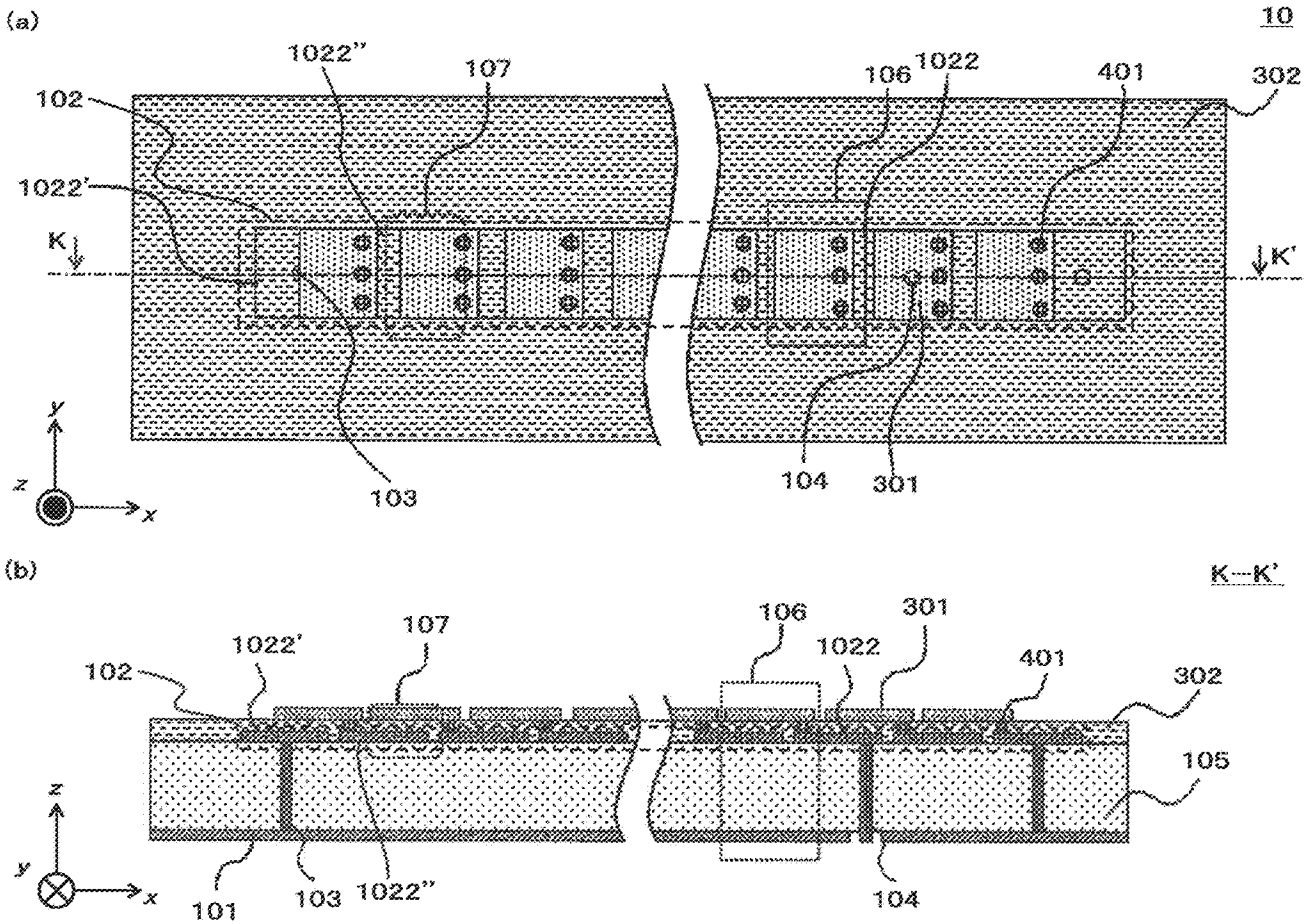
FIG. 22 is a diagram illustrating a configuration example of an antenna 10 in a third exemplary embodiment.

FIG. 22 is a diagram illustrating a configuration example of an antenna 10 in a third exemplary embodiment. FIG. 22(*a*) illustrates a top view of the antenna 10 in the third exemplary embodiment. Further, FIG. 22(*b*) illustrates a cross-sectional view along a line segment K-K' of FIG. 22(*a*). As illustrated in FIG. 22, the antenna 10 of the present exemplary embodiment further includes a plurality of conductor vias 401.

In the antenna 10 of the present exemplary embodiment, as illustrated in FIG. 22, the auxiliary conductor 301 is electrically connected to one of two island-shaped conductors 1022 that partially overlap therewith in planar view via the conductor via 401. Further, while the auxiliary conductor 301 and one of the two island-shaped conductors 1022 are electrically connected via the conductor via 401, the auxiliary conductor 301 forms a capacitance by facing the other island-shaped conductor 1022. As a result, a capacitance is formed between one island-shaped conductor 1022 and the other island-shaped conductor 1022.

Also in the present exemplary embodiment, a medium of the dielectric medium 302 is not specifically limited. When, for example, the antenna 10 is produced using a printed circuit board process, the dielectric medium 302 is supposed to be various types of dielectric materials. Further, when the antenna 10 is produced using a sheet-metal technique, the dielectric medium 302 is supposed to be air.

Further, in FIG. 22, an example in which three conductor vias 401 are provided for each unit cell 106 has been illustrated. However, the number of conductor vias 401 is not limited thereto. The number of conductor vias 401 may be one or two or may be greater than three.

In the second exemplary embodiment, the capacitance formation part 107 is configured by serially connecting a capacitance between one island-shaped conductor 1022 of two adjacent island-shaped conductors 1022 and the auxiliary conductor 301 and a capacitance between the other island-shaped conductor 1022 and the auxiliary conductor 301. In contrast, in the present exemplary embodiment, the capacitance formation part 107 is configured using only a capacitance between one of two adjacent island-shaped conductors 1022 and the auxiliary conductor 301. Thereby, according to the present exemplary embodiment, a capacitance value of the capacitance formation part 107 can be increased, compared with the second exemplary embodiment. Therefore, according to the present exemplary embodiment, an antenna in which an area of the unit cell 106 is small can be realized while operating at lower frequency than that of the second exemplary embodiment. In other words, an antenna in which even in a vicinity of the antenna, a spacial position dependency of a power reception intensity of an IC tag is small can be realized.

Further, in the antenna 10 of the present exemplary embodiment, an electric field that occurs in a capacitance between two adjacent island-shaped conductors 1022 occurs in a space between the auxiliary conductor 301 and the island-shaped conductor 1022 facing the auxiliary conductor 301. Therefore, when an IC tag comes close to an upper portion of the antenna 10, a variation of a capacitance value between the two adjacent island-shaped conductors 1022 decreases. In other words, the present exemplary embodiment may reduce an influence on the antenna 10, when the IC tag comes close to an upper portion of the antenna 10.

Figure 23:
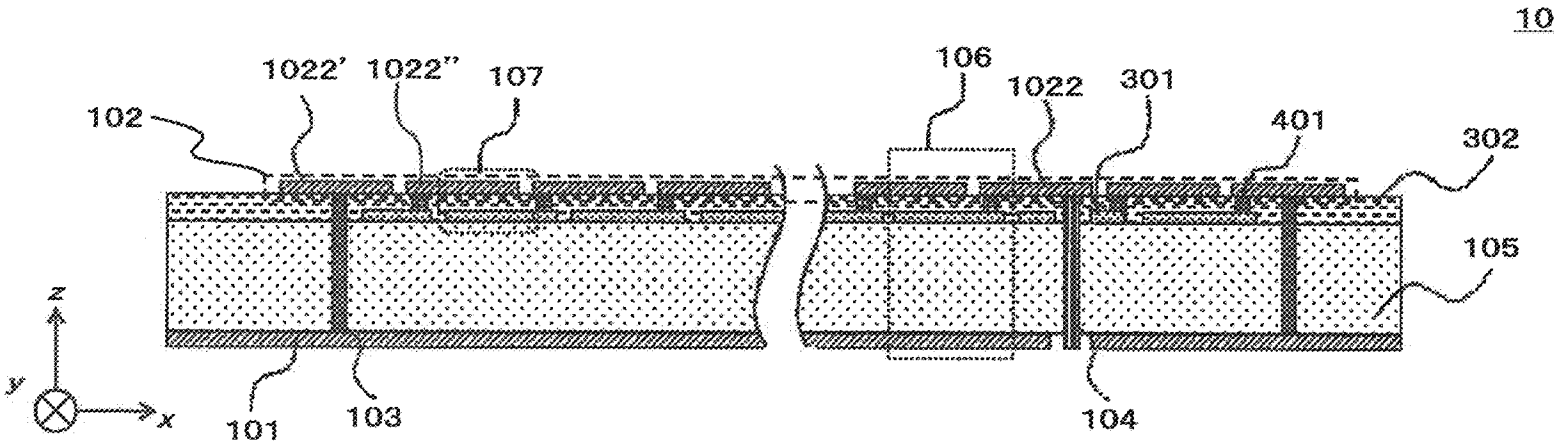
FIG. 23 is a diagram illustrating another configuration example of the antenna 10 in the third exemplary embodiment.

Further, in FIG. 22, an example in which a plurality of auxiliary conductors 301 are disposed in a layer above the island-shaped conductor group 102 has been illustrated, but a disposition position of the plurality of auxiliary conductors 301 is not limited thereto. As illustrated in FIG. 23, a plurality of auxiliary conductors 301 may be disposed, for example, in a layer below the island-shaped conductor group 102. FIG. 23 is a diagram illustrating another configuration example of the antenna 10 in the third exemplary embodiment. Also in this case, in the same manner as in FIG. 22, the auxiliary conductor 301 is electrically connected to one of two island-shaped conductors 1022 that partially overlap therewith in planar view via the conductor via 401. Even in such a configuration, the above-described advantageous effect of the present exemplary embodiment is obtainable.

Fourth Exemplary Embodiment

The present exemplary embodiment is the same as the first exemplary embodiment except for the following points.

Figure 24:
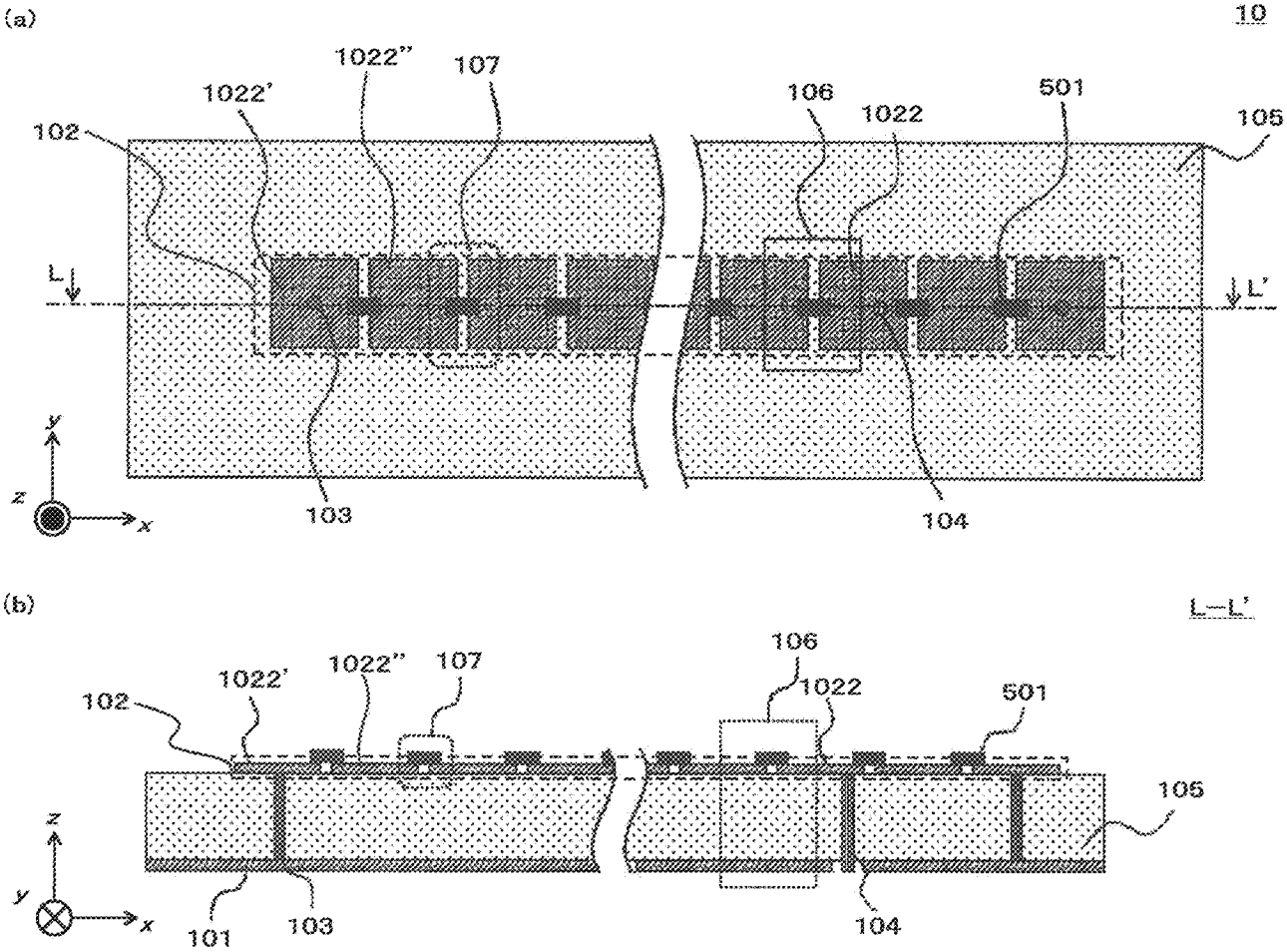
FIG. 24 is a diagram illustrating a configuration example of an antenna 10 in a fourth exemplary embodiment.

FIG. 24 is a diagram illustrating a configuration example of an antenna 10 in a fourth exemplary embodiment. FIG. 24(*a*) illustrates a top view of the antenna 10 in the fourth exemplary embodiment. Further, FIG. 24(*b*) illustrates a cross-sectional view along a line segment L-L' of FIG. 24(*a*). As illustrated in FIG. 24, the antenna 10 of the present exemplary embodiment further includes a plurality of chip capacitances 501.

In the antenna 10 of the present exemplary embodiment, as illustrated in FIG. 24, two adjacent island-shaped conductors 1022 are connected via the chip capacitance 501. Specifically, one end of the chip capacitance 501 is connected to one island-shaped conductor 1022 of the two adjacent island-shaped conductors 1022, and the other end of the chip capacitance 501 is connected to the other island-shaped conductor 1022. In FIG. 24, an example in which the chip capacitance 501 is directly connected to two island-shaped conductors 1022 has been illustrated. However, without limitation thereto, the chip capacitance 501 may be connected to each of adjacent island-shaped conductors 1022 via a conductor via, a conductor pattern, or the like. The chip capacitance 501 may be connected, for example, in the same layer as a layer where the island-shaped conductor 1022 is disposed, to island-shaped conductor groups 102, respectively, via a conductor pattern. Further, when another dielectric layer is provided above a layer where the island-shaped conductor group 102 is disposed, the chip capacitance 501 may be disposed above the dielectric layer, and the chip capacitance 501 and island-shaped conductors 1022 are connected via a conductor via.

In the antenna 10 of the present exemplary embodiment, the chip capacitance 501 is used, and therefore, a large capacitance value is easily obtainable. Further, according to Formula 4 described above, an operating frequency of the antenna 10 of the present invention is determined by a capacitance between two adjacent island-shaped conductors 1022 and inductances of the island-shaped conductor 1022 and the conductor plane 101. In the antenna 10 of the present exemplary embodiment, by using the chip capacitance 501, a capacitance value between two adjacent island-shaped conductors 1022 can be increased. Therefore, according to the present exemplary embodiment, an antenna in which an area of the unit cell 106 is small can be realized while operating at low frequency. In other words, an antenna in which even in a vicinity of the antenna, a space position dependency of a power reception intensity of an IC tag is small is realizable.

Further, in the antenna 10 of the present exemplary embodiment, a capacitance between two adjacent island-shaped conductors 1022 is mainly realized using the chip capacitance 501. Therefore, even when an IC tag comes close to an upper portion of the antenna 10, a capacitance value between the two adjacent island-shaped conductors 1022 is not substantially varied. In other words, the present exemplary embodiment may reduce an influence of an IC tag on the antenna 10, when the IC tag comes close to an upper portion of the antenna 10.

Further, in the antenna 10 of the present exemplary embodiment, a capacitance value between two adjacent island-shaped conductors 1022 can be easily changed in accordance with a capacitance value of the chip capacitance 501 provided between the two adjacent island-shaped conductors 1022. In other words, according to the present exemplary embodiment, an operating frequency of the antenna 10 can be easily changed.

Fifth Exemplary Embodiment

In the present exemplary embodiment, the island-shaped conductor group 102 includes a plurality of island-shaped conductors 1022 two-dimensionally arranged to face the conductor plane 101.

Figure 25:
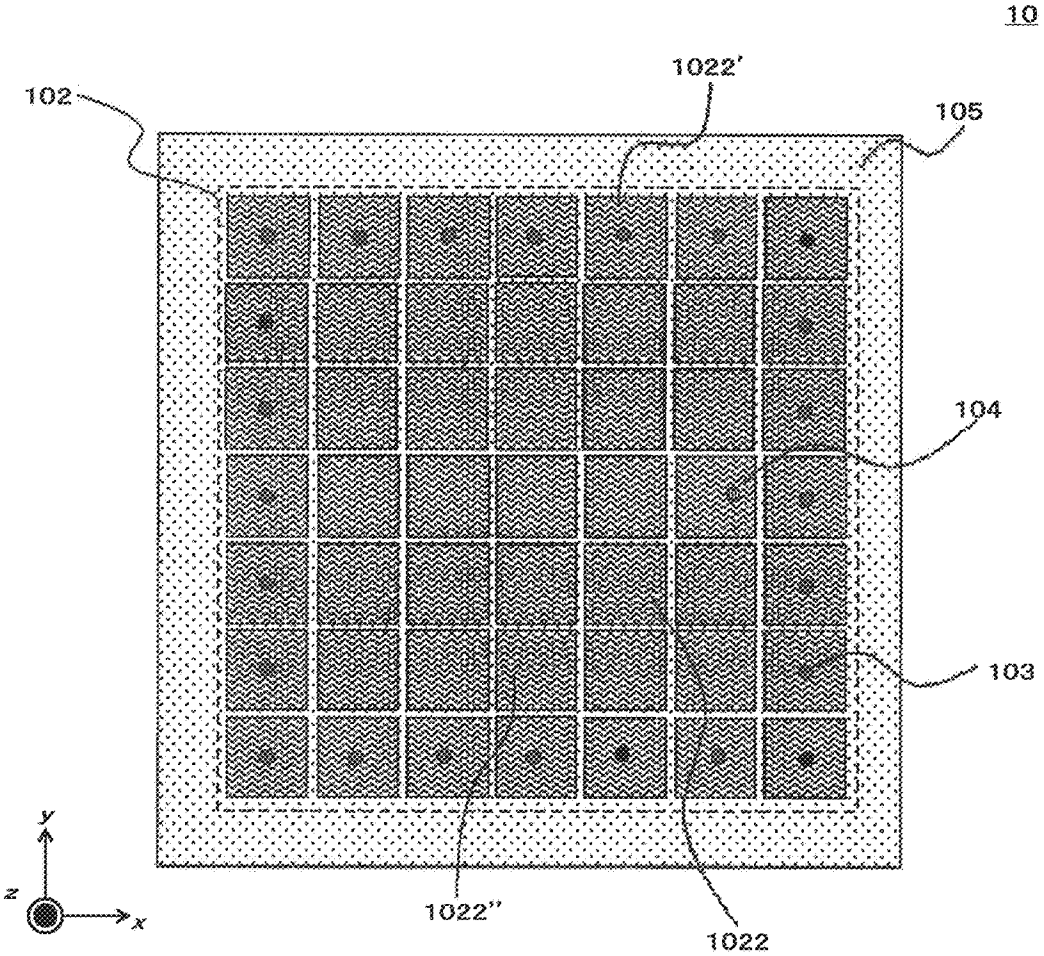
FIG. 25 is a top view of an antenna 10 in a fifth exemplary embodiment.

FIG. 25 is a top view of an antenna 10 in a fifth exemplary embodiment. As illustrated in FIG. 25, the island-shaped conductor 1022 surrounded by the first island-shaped conductors 1022' lies adjacent to at least three or more other island-shaped conductors 1022. Specifically, in FIG. 25, two other island-shaped conductors 1022 lie adjacent to a given island-shaped conductor 1022 in the x-axis direction and the y-axis direction, respectively. The conductor via 103 is provided in a vicinity of the center of the first island-shaped conductor 1022' in the y-axis direction of FIG. 25. The conductor via 103 connected to the first island-shaped conductor 1022' of the y-axis direction is a component necessary to satisfy a boundary condition of a zeroth-order resonance mode in the y-axis direction. Therefore, when a zeroth-order resonance mode is to be excited only in the x-axis direction, it is not necessary to provide the conductor via 103 of the y-axis direction. The conductor via 103 of the y-axis direction is connected in the same manner as in the first exemplary embodiment on the basis of the condition of a connection position of the conductor via 103 described in the first exemplary embodiment.

Although not illustrated, as with the present exemplary embodiment, adjacent island-shaped conductors 1022 are capacitively connectable via the auxiliary conductor 301 in the same manner as in the second exemplary embodiment. As a shape of the auxiliary conductor 301, various shapes are employable as described in the second exemplary embodiment. Further, at that time, as a medium of a space sandwiched by the island-shaped conductor group 102 and the auxiliary conductor 301, various media are employable in the same manner as in the exemplary embodiments described above. Further, the configurations of the modified examples of the first exemplary embodiment and the third and fourth exemplary embodiments can be combined.

Further, in FIG. 25, an example in which a shape of each island-shaped conductor 1022 is a square has been illustrated. However, the shape of each island-shaped conductor 1022 is not limited thereto. The shape of each island-shaped conductor 1022 may be a shape other than a square in the same manner as in the above-described exemplary embodiments. However, when the auxiliary conductor 301 is not used, the number of other adjacent island-shaped conductors 1022 is changed in accordance with a shape of the island-shaped conductors 1022.

In the antenna 10 of the present exemplary embodiment, a polarization plane of a radiated electromagnetic wave is selectable on the basis of a relative connection position of the power feeding part 104 in the island-shaped conductor group 102. When, for example, using the x-axis direction as a reference, the power feeding part 104 is disposed to be deviated from the center of the island-shaped conductor 1022 as illustrated in FIG. 25, the antenna 10 excites a zeroth-order resonance mode in the x-axis direction. At that time, the polarization of an electromagnetic wave to be radiated becomes a linearly polarized in the x-axis direction.

Figure 26:
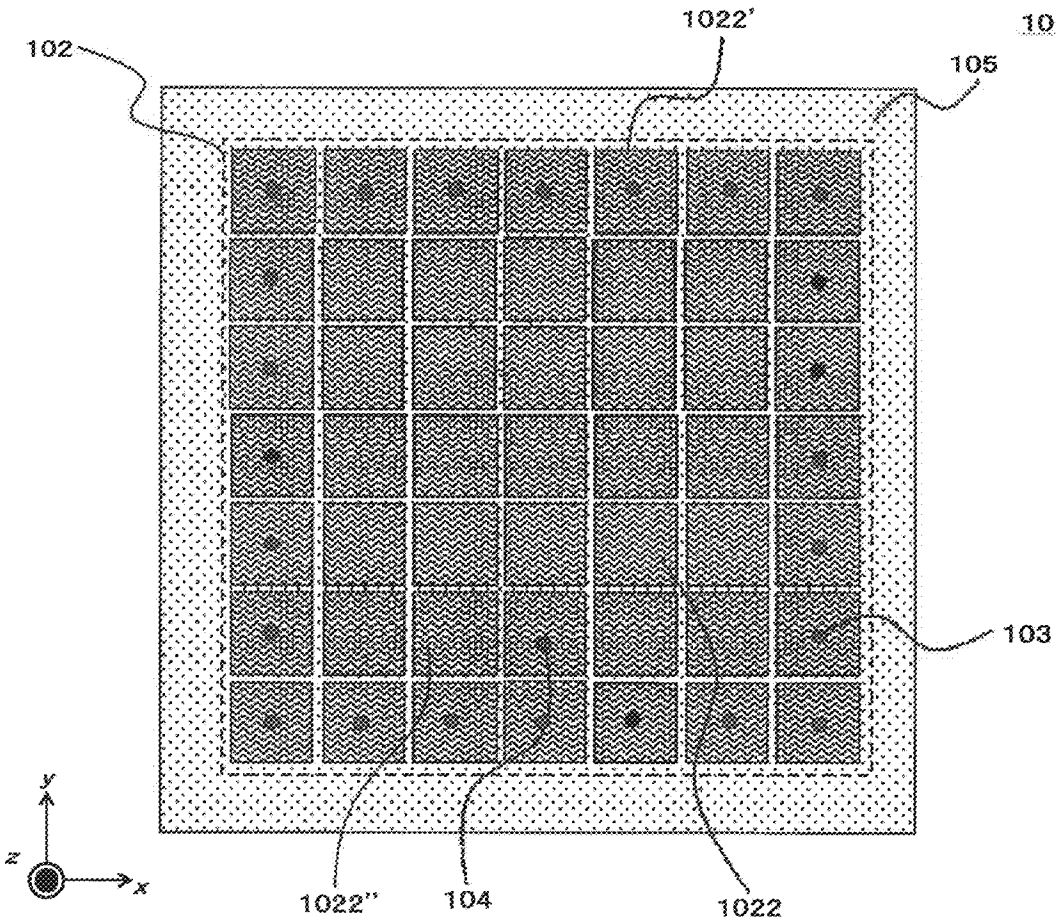
FIG. 26 is a diagram illustrating another configuration example of the antenna 10 in the fifth exemplary embodiment.

Further, the power feeding part 104 may be connected as illustrated in FIG. 26. FIG. 26 is a diagram illustrating another configuration example of the antenna 10 in the fifth exemplary embodiment. In FIG. 26, using a y-axis direction as a reference, the power feeding part 104 is disposed to be deviated from the center of the island-shaped conductor 1022. In this case, the antenna 10 excites a zeroth-order resonance mode in the y-axis direction. At that time, the polarization of an electromagnetic wave to be radiated becomes a linearly polarized in the y-axis direction.

Figure 27:
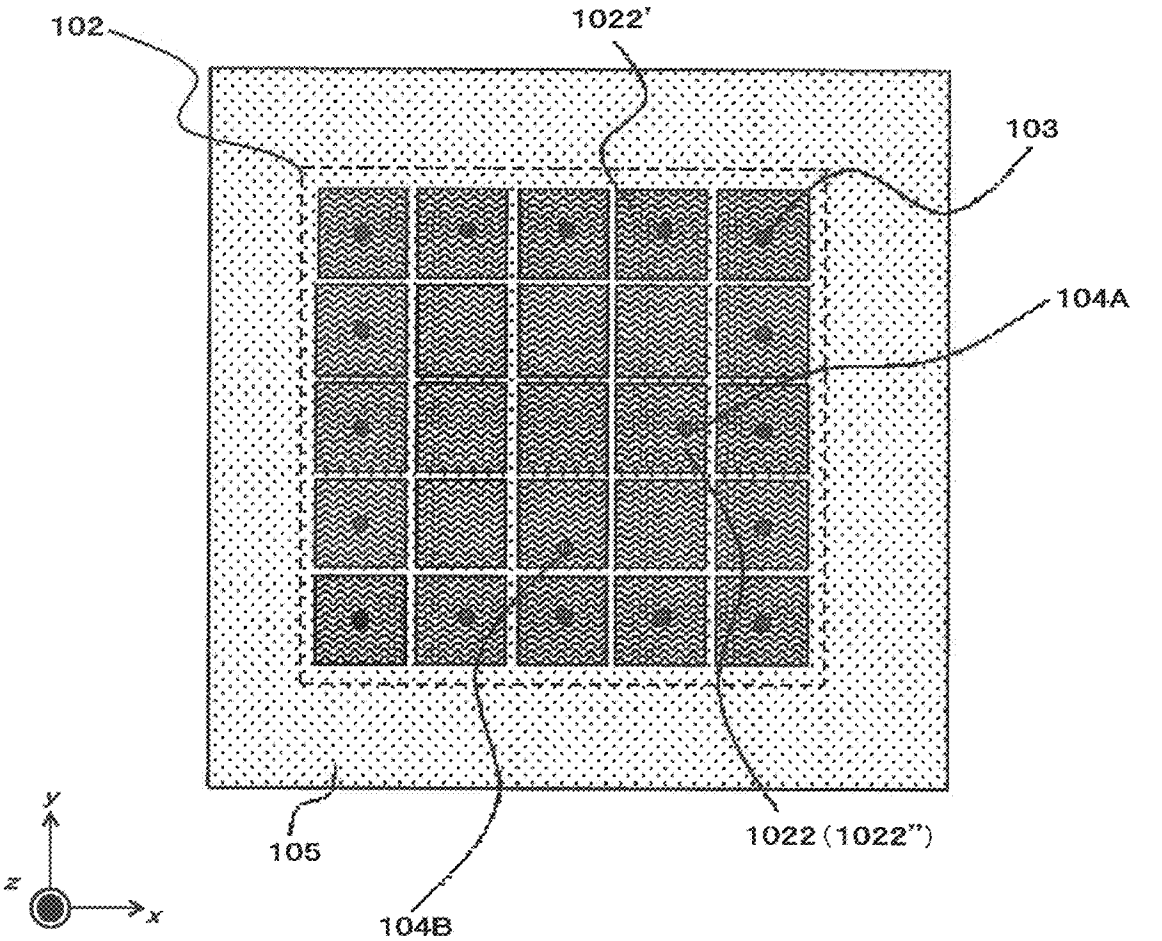
FIG. 27 is a diagram illustrating another configuration example of the antenna 10 in the fifth exemplary embodiment.

Further, a plurality of power feeding parts 104 may be connected as illustrated in FIG. 27. FIG. 27 is a diagram illustrating another configuration example of the antenna 10 in the fifth exemplary embodiment. The antenna 10 of FIG. 27 includes a power feeding part 104A disposed to be deviated from the center of the island-shaped conductor 1022 with respect to an x-axis direction (a first arrangement direction of the island-shaped conductor group 102) and a power feeding part 104B disposed to be deviated from the center of the island-shaped conductor 1022 with respect to a y-axis direction (a second arrangement direction of the island-shaped conductor group 102). In this case, the antenna 10 excites a zeroth-order resonance mode in both of the x-axis direction and the y-axis direction. At that time, when the two power feeding parts 104A and 104B are excited in the same phase, the polarization of electromagnetic waves to be radiated become a linearly polarized inclined to the x-axis and the y-axis. This inclination angle is determined by an energy ratio of the excited zeroth-order resonance mode of the x-axis direction and the excited zeroth-order resonance mode of the y-axis direction.

Figure 28:
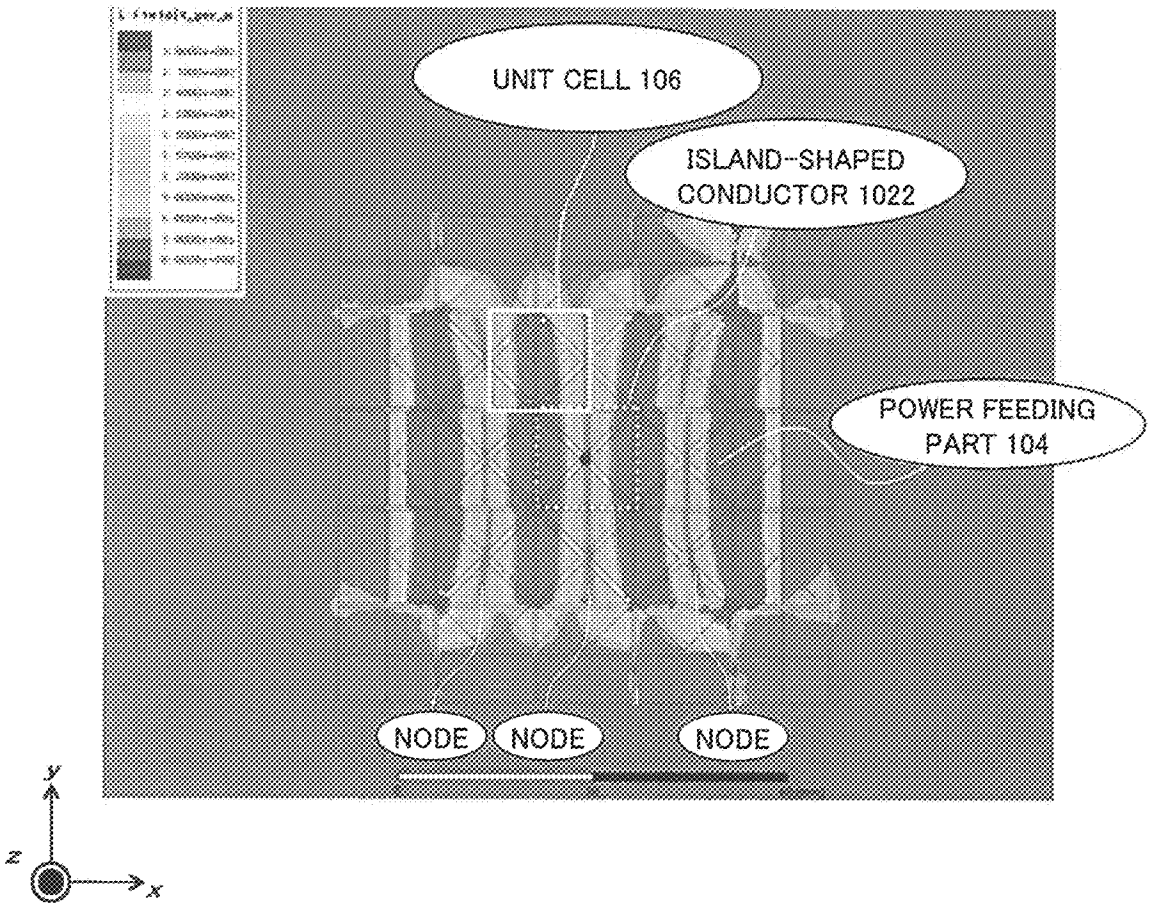
FIG. 28 is a diagram illustrating an electric field distribution on a conductor plane 101 in which a power feeding part 104 is disposed to be deviated from the center of an island-shaped conductor 1022 using an x-axis direction as a reference.

FIG. 28 is a diagram illustrating an electric field intensity distribution on the conductor plane 101 in which the power feeding part 104 is disposed to be deviated from the center of the island-shaped conductor 1022 using an x-axis direction as a reference. In other words, the distribution is equivalent to an electric field intensity distribution of the antenna 10 of the present exemplary embodiment exemplified in FIG. 25. According to FIG. 28, it is understood that there is no phase advance for each unit cell 106 in the x-axis direction and the same electric field intensity pattern is repeated.

Figure 29:
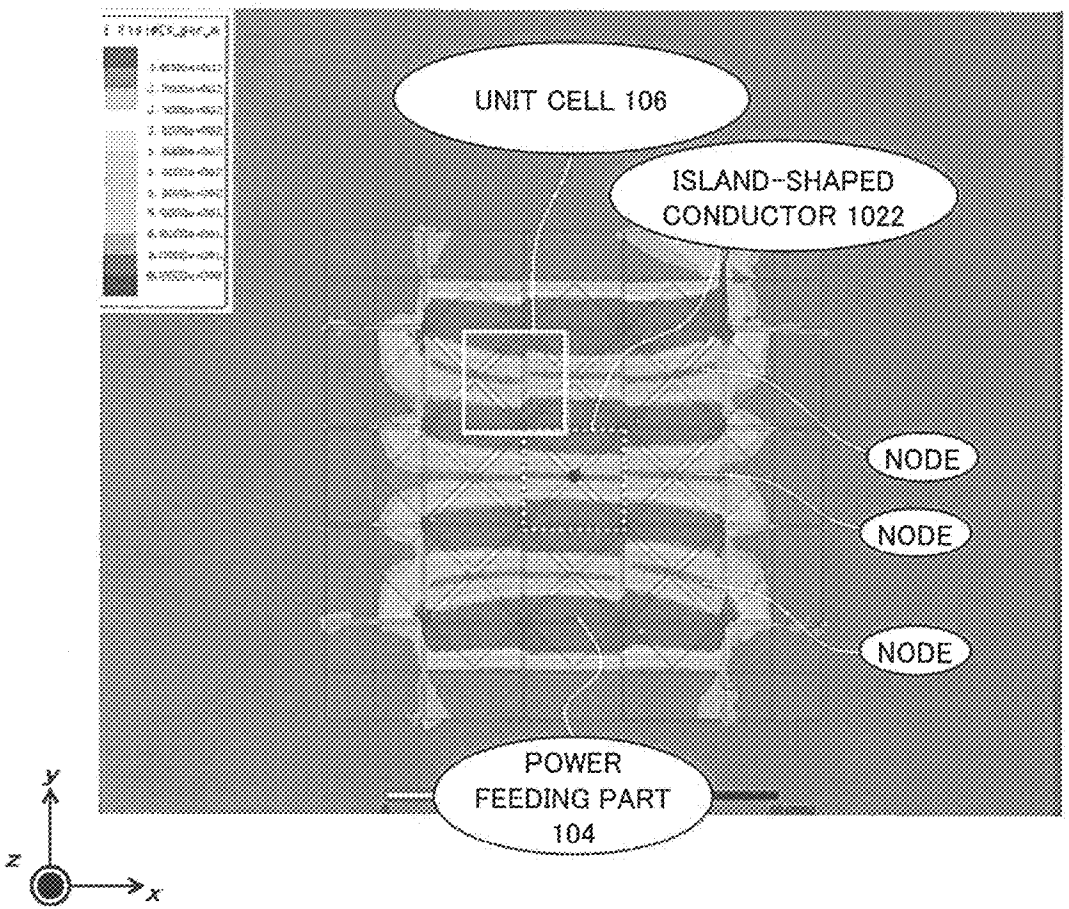
FIG. 29 is a diagram illustrating an electric field distribution on the conductor plane 101 in which the power feeding part 104 is disposed to be deviated from the center of the island-shaped conductor 1022 using a y-axis direction as a reference.

FIG. 29 is a diagram illustrating an electric field intensity distribution on the conductor plane 101 in which the power feeding part 104 is disposed to be deviated from the center of the island-shaped conductor 1022 using a y-axis direction as a reference. In other words, the distribution is equivalent to an electric field intensity distribution of the antenna 10 of the present exemplary embodiment exemplified in FIG. 26. According to FIG. 29, it can be understood that there is no phase advance for each unit cell 106 in the y-axis direction and the same electric field intensity pattern is repeated.

As can be seen from the distributions of electric field intensity illustrated in FIG. 28 and FIG. 29, the antenna 10 of the present exemplary embodiment can select a zeroth-order resonance mode to be excited in accordance with a connection position of the power feeding part 104. Therefore, the polarization is controllable. When, for example, the power feeding part 104A and the power feeding part 104B are excited with a phase difference in the configuration of FIG. 27, the antenna 10 can generate a circularly polarized wave. When a circularly polarized wave is generated, a phase difference between the power feeding part 104A and the power feeding part 104B is preferably approximately 90 degrees. However, the phase difference between the power feeding part 104A and the power feeding part 104B may have a range to some extent. The phase difference between the power feeding part 104A and the power feeding part 104B may be equal to or greater than 60 degrees and equal to or smaller than 120 degrees, or may be equal to or greater than 70 degrees and equal to or smaller than 110 by being made closer to 90 degrees, for example. Even with a range in this manner, a circularly polarized wave can be generated. It is assumed that the circularly polarized wave here is not a perfect circularly polarized wave but a concept including also an elliptically polarized wave.

Figure 30:
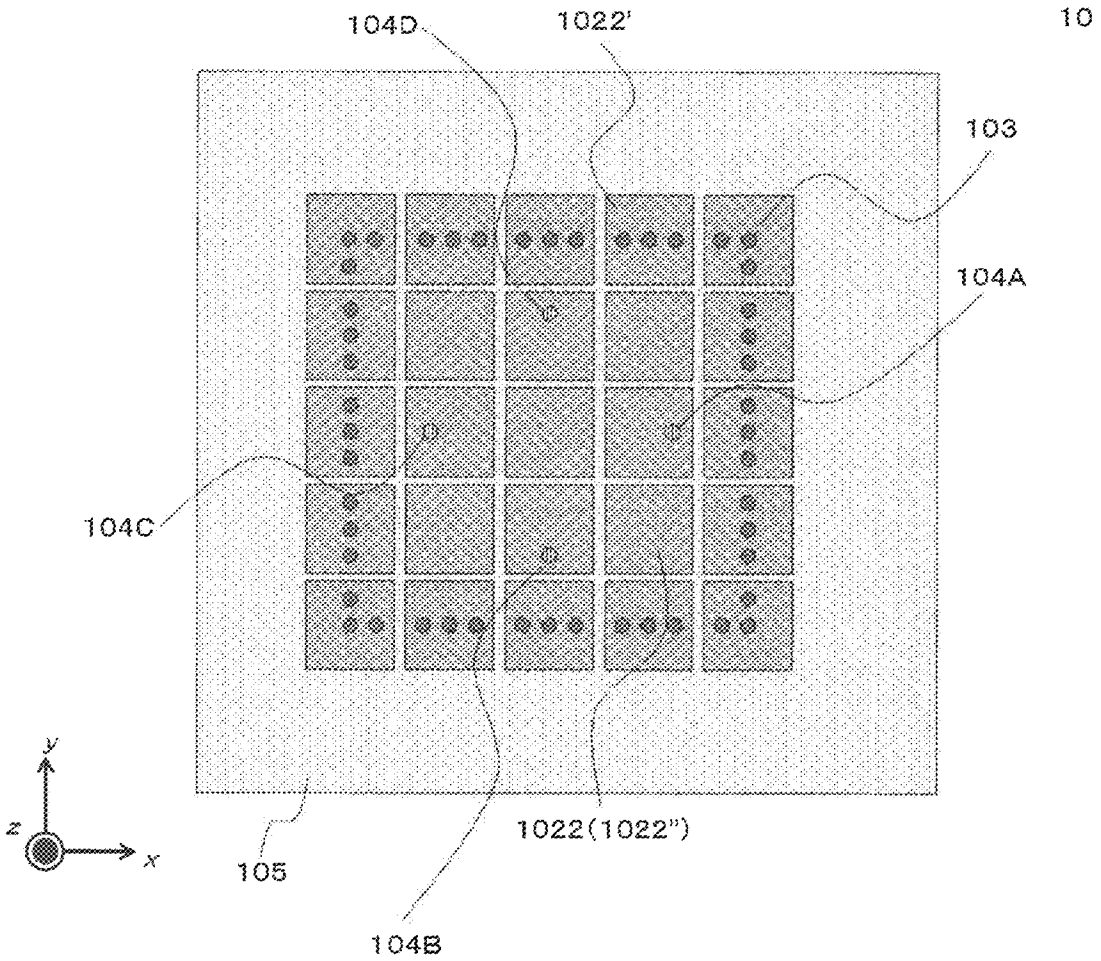
FIG. 30 is a diagram illustrating another configuration example of the antenna 10 in the fifth exemplary embodiment.

Further, when a circularly polarized wave is generated, the antenna 10 may be configured as illustrated in FIG. 30. FIG. 30 is a diagram illustrating another configuration example of the antenna 10 in the fifth exemplary embodiment. In FIG. 30, the antenna 10 further includes a power feeding part 104C and a power feeding part 104D, in addition to the power feeding part 104A and the power feeding part 104B. Further, in FIG. 30, phase differences between the power feeding parts 104A and 104B, between the power feeding part 104A and the power feeding part 104C, and between the power feeding part 104A and the power feeding part 104D are set to be 90 degrees, 180 degrees, and 270 degrees, respectively. Further, in FIG. 30, for each first island-shaped conductor 1022', three conductor vias 103 are provided. The number of conductor vias 103 may be one or two or may be greater than three.

Figure 31:
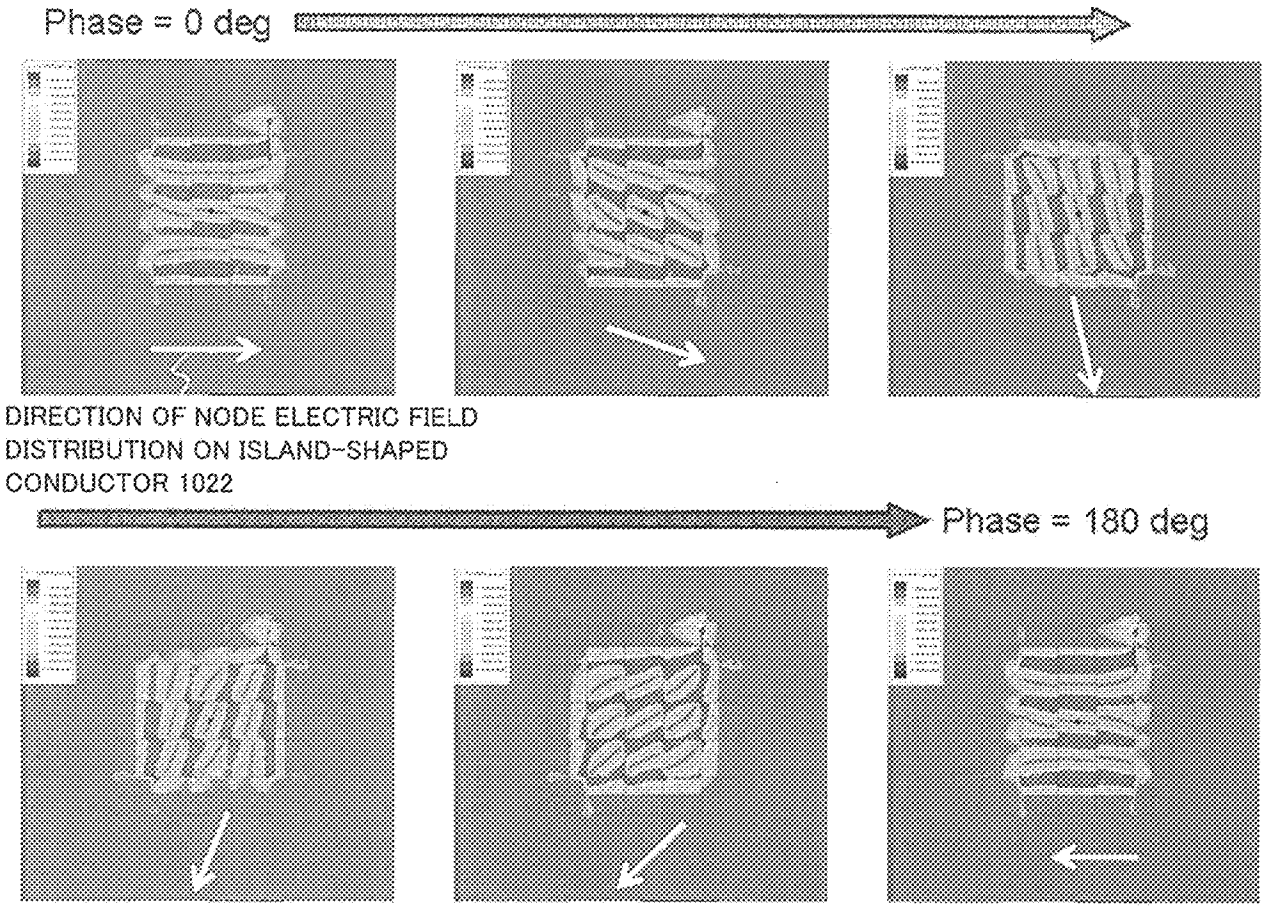
FIG. 31 is a diagram illustrating an electric field distribution on the conductor plane 101 in the configuration of FIG. 30.
Figure 32:
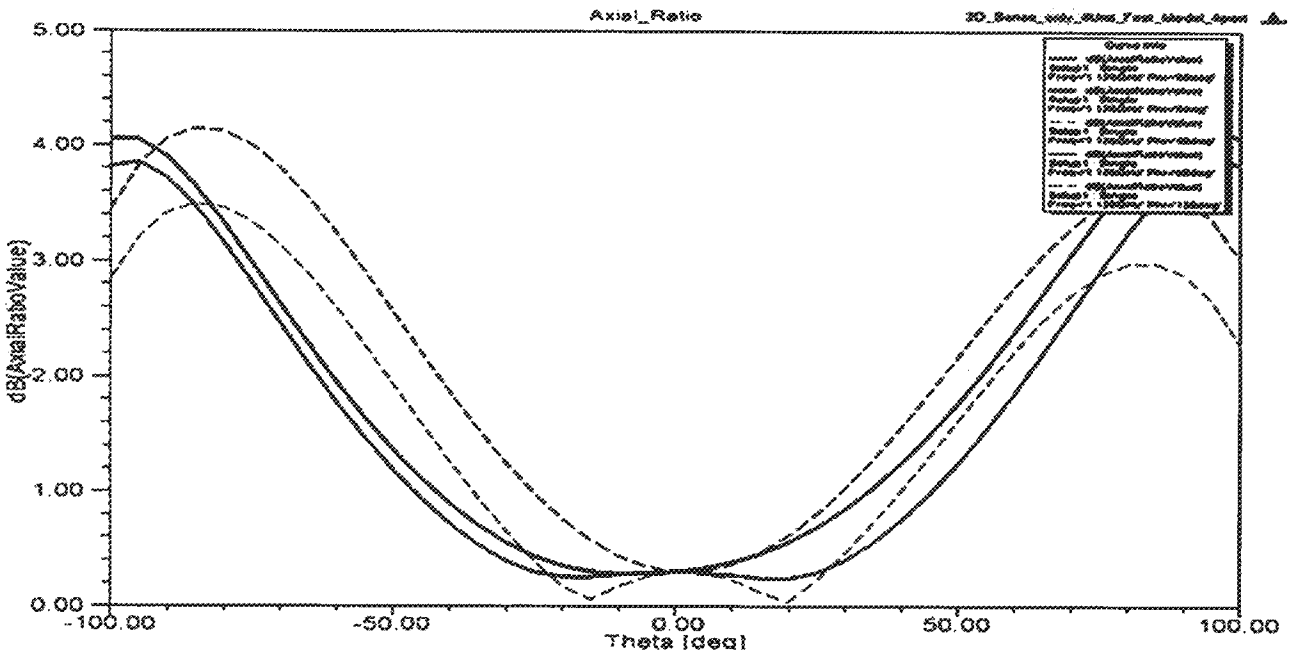
FIG. 32 is a diagram illustrating calculation results of radiation angle dependency of an axial ratio of a circularly polarized wave in the antenna 10 of FIG. 30.

According to such a configuration, an electric field distribution as illustrated in FIG. 31 is obtained. FIG. 31 is a diagram illustrating an electric field distribution on the conductor plane 101 in the configuration of FIG. 30. As can be seen from FIG. 30, a line segment that is a node of an electric field distribution in each island-shaped conductor 1022 rotates in accordance with a phase, and the antenna 10 operates as a circular polarized antenna. Further, FIG. 32 illustrates calculation results of radiation angle dependency of an axial ratio of a circularly polarized wave in the antenna 10 of FIG. 30. As can be seen from FIG. 32, the antenna 10 of FIG. 30 has a favorable circularly polarized wave characteristic in which an axial ratio in a zenithal direction is approximately 0.5 dB or less. In other words, according to the present exemplary embodiment, a circular polarized antenna having a favorable circularly polarized wave characteristic can be realized.

While exemplary embodiments of the present invention have been described with reference to the drawings, these exemplary embodiments are illustrative of the present invention and various configurations other than the above-described configurations are employable.

Using, for example, a printed circuit board process, a printed circuit board including the antenna 10 in the above-described exemplary embodiments and modified examples can be produced. Further, the antenna 10 in the above-described exemplary embodiments and modified examples and a printed circuit board including the antenna 10 can be incorporated in an electronic device.

The above-described exemplary embodiments and modified examples can be combined to the extent that the contents do not conflict.

Hereafter, examples of reference aspects will be supplementarily noted.

1. An antenna including:

a conductor plane;

an island-shaped conductor group including a plurality of island-shaped conductors arranged so as to face the conductor plane via a dielectric medium;

at least one power feeding part that is connected to one of the plurality of island-shaped conductors of the island-shaped conductor group and that transmits power; and a connection part that electrically connects the conductor plane and a first island-shaped conductor that is the island-shaped conductor located on an outermost side of the island-shaped conductor group, wherein each of the plurality of the island-shaped conductors is capacitively connected to another island-shaped conductor or other island-shaped conductors adjacent thereto, the power feeding part is connected to a position other than a center of the island-shaped conductor in an arrangement direction of the island-shaped conductor group, and the connection part is connected to a position inside the first island-shaped conductor by approximately half a width of a second island-shaped conductor, from a portion facing the second island-shaped conductor that is the island-shaped conductor located adjacent to the first island-shaped conductor, out of an edge of the first island-shaped conductor, in the arrangement direction of the island-shaped conductor group.

2. The antenna according to 1., wherein, when an effective wavelength in a space between the conductor plane and the island-shaped conductor group of an electromagnetic wave transmitted or received by the antenna is designated as $\lambda_0$, a size of the island-shaped conductor in the arrangement direction of the island-shaped conductor group is smaller than $\lambda_0/2$.

3. The antenna according to 1. or 2., wherein adjacent two of the island-shaped conductors are capacitively connected by being close to each other.

4. The antenna according to 1. or 2., wherein adjacent two of the island-shaped conductors are capacitively connected in the island-shaped conductor group via an auxiliary conductor disposed so as to partially overlap with each of the adjacent two island-shaped conductors in planar view.

5. The antenna according to any one of 1. to 4., wherein the connection part is a conductor via.

6. The antenna according to any one of 1. to 4., wherein the connection part is configured by cascadedly connecting any one of a chip capacitance, a third island-shaped conductor, and a transmission line in which one end thereof is an open end, and a conductor via, and electrically connects the conductor plane and the first island-shaped conductor.

7. The antenna according to any one of 1. to 6., wherein the plurality of island-shaped conductors included in the island-shaped conductor group is two-dimensionally arranged so as to face the conductor plane.

8. The antenna according to 7., including at least two or more of the power feeding parts, wherein at least one of the at least two or more of the power feeding parts is connected to a position other than a center of the island-shaped conductor in a first arrangement direction of the island-shaped conductor group, another of the at least two or more of the power feeding part is connected to a position other than a center of the island-shaped conductor in a second arrangement direction of the island-shaped conductor group, and a phase difference of power fed to the respective power feeding parts adjacent to each other in an outer circumferential direction of the island-shaped conductor group is greater than or equal to 60 degrees and smaller than 120 degrees.

9. The antenna according to any one of 1. to 8., further including a circuit part that matches impedance by adding a capacitance component or an inductance component, wherein the circuit part is disposed in at least one of a midway of the power feeding part and a position between the conductor plane and the power feeding part.

10. A printed circuit board including an antenna, wherein the antenna including:

a conductor plane;

an island-shaped conductor group including a plurality of island-shaped conductors arranged so as to face the conductor plane via a dielectric medium;

at least one power feeding part that is connected to one of the plurality of island-shaped conductors of the island-shaped conductor group and that transmits power; and a connection part that electrically connects the conductor plane and a first island-shaped conductor that is the island-shaped conductor located on an outermost side of the island-shaped conductor group, wherein each of the plurality of the island-shaped conductors is capacitively connected to another island-shaped conductor or other island-shaped conductors adjacent thereto, the power feeding part is connected to a position other than a center of the island-shaped conductor in an arrangement direction of the island-shaped conductor group, and the connection part is connected to a position inside the first island-shaped conductor by approximately half a width of a second island-shaped conductor, from a portion facing the second island-shaped conductor that is the island-shaped conductor located adjacent to the first island-shaped conductor, out of an edge of the first island-shaped conductor, in the arrangement direction of the island-shaped conductor group.

11. The printed circuit board according to 10., wherein, when an effective wavelength in a space between the conductor plane and the island-shaped conductor group of an electromagnetic wave transmitted or received by the antenna is designated as $\lambda_0$, a size of the island-shaped conductor in the arrangement direction of the island-shaped conductor group is smaller than $\lambda_0/2$.

12. The printed circuit board according to 10. or 11., wherein adjacent two of the island-shaped conductors are capacitively connected by being close to each other.

13. The printed circuit board according to 10. or 11., wherein adjacent two of the island-shaped conductors are capacitively connected in the island-shaped conductor group via an auxiliary conductor disposed so as to partially overlap with each of the adjacent two island-shaped conductors in planar view.

14. The printed circuit board according to any one of 10. to 13., wherein the connection part is a conductor via.

15. The printed circuit board according to any one of 10. to 13., wherein the connection part is configured by cascadedly connecting any one of a chip capacitance, a third island-shaped conductor, and a transmission line in which one end thereof is an open end, and a conductor via, and electrically connects the conductor plane and the first island-shaped conductor.

16. The printed circuit board according to any one of 10. to 15., wherein the plurality of island-shaped conductors included in the island-shaped conductor group is two-dimensionally arranged so as to face the conductor plane.

17. The printed circuit board according to 16., including at least two or more of the power feeding parts, wherein at least one of the at least two or more of the power feeding parts is connected to a position other than a center of the island-shaped conductor in a first arrangement direction of the island-shaped conductor group, another of the at least two or more of the power feeding part is connected to a position other than a center of the island-shaped conductor in a second arrangement direction of the island-shaped conductor group, and a phase difference of power fed to the respective power feeding parts adjacent to each other in an outer circumferential direction of the island-shaped conductor group is greater than or equal to 60 degrees and smaller than 120 degrees.

18. The printed circuit board according to any one of 10. to 17., further including a circuit part that matches impedance by adding a capacitance component or an inductance component, wherein the circuit part is disposed in at least one of a midway of the power feeding part and a position between the conductor plane and the power feeding part.

19. An electronic device including an antenna, wherein the antenna including:

a conductor plane;

an island-shaped conductor group including a plurality of island-shaped conductors arranged so as to face the conductor plane via a dielectric medium;

at least one power feeding part that is connected to one of the plurality of island-shaped conductors of the island-shaped conductor group and that transmits power; and a connection part that electrically connects the conductor plane and a first island-shaped conductor that is the island-shaped conductor located on an outermost side of the island-shaped conductor group, wherein each of the plurality of the island-shaped conductors is capacitively connected to another island-shaped conductor or other island-shaped conductors adjacent thereto, the power feeding part is connected to a position other than a center of the island-shaped conductor in an arrangement direction of the island-shaped conductor group, and the connection part is connected to a position inside the first island-shaped conductor by approximately half a width of a second island-shaped conductor, from a portion facing the second island-shaped conductor that is the island-shaped conductor located adjacent to the first island-shaped conductor, out of an edge of the first island-shaped conductor, in the arrangement direction of the island-shaped conductor group.

20. The electronic device according to 19., wherein, when an effective wavelength in a space between the conductor plane and the island-shaped conductor group of an electromagnetic wave transmitted or received by the antenna is designated as $\lambda_0$, a size of the island-shaped conductor in the arrangement direction of the island-shaped conductor group is smaller than $\lambda_0/2$.

21. The electronic device according to 19. or 20., wherein adjacent two of the island-shaped conductors are capacitively connected by being close to each other.

22. The electronic device according to 19. or 20., wherein adjacent two of the island-shaped conductors are capacitively connected in the island-shaped conductor group via an auxiliary conductor disposed so as to partially overlap with each of the adjacent two island-shaped conductors in planar view.

23. The electronic device according to any one of 19 to 22., wherein the connection part is a conductor via.

24. The electronic device according to any one of 19. to 22., wherein the connection part is configured by cascadedly connecting any one of a chip capacitance, a third island-shaped conductor, and a transmission line in which one end thereof is an open end, and a conductor via, and electrically connects the conductor plane and the first island-shaped conductor.

25. The electronic device according to any one of 19. to 24., wherein the plurality of island-shaped conductors included in the island-shaped conductor group is two-dimensionally arranged so as to face the conductor plane.

26. The electronic device according to 25., including at least two or more of the power feeding parts, wherein at least one of the at least one or more of the power feeding parts is connected to a position other than a center of the island-shaped conductor in a first arrangement direction of the island-shaped conductor group, another of the at least two or more of the power feeding part is connected to a position other than a center of the island-shaped conductor in a second arrangement direction of the island-shaped conductor group, and a phase difference of power fed to the respective power feeding parts adjacent to each other in an outer circumferential direction of the island-shaped conductor group is greater than or equal to 60 degrees and smaller than 120 degrees.

27. The electronic device according to any one of 19. to 26., further including a circuit part that matches impedance by adding a capacitance component or an inductance component, wherein the circuit part is disposed in at least one of a midway of the power feeding part and a position between the conductor plane and the power feeding part.

This application is based upon and claims the benefit of priority from Japanese patent application No. 2013-229267, filed on Nov. 5, 2013, the disclosure of which is incorporated herein in its entirety by reference.

What is claimed is:

1. An antenna comprising:

a conductor plane;

an island-shaped conductor group including a plurality of island-shaped conductors arranged so as to face the conductor plane;

at least one power feeding part that is connected to one of the plurality of island-shaped conductors of the island-shaped conductor group and that transmits power; and a connection part that electrically connects the conductor plane and a first island-shaped conductor that is the island-shaped conductor located on an outermost side of the island-shaped conductor group, wherein each of the plurality of the island-shaped conductors is capacitively connected to another island-shaped conductor or other island-shaped conductors adjacent thereto, the power feeding part is connected to a position other than a center of the island-shaped conductor in an arrangement direction of the island-shaped conductor group, and the connection part is connected to a position in the first island-shaped conductor by approximately half a width of a second island-shaped conductor, from a portion facing the second island-shaped conductor that is the island-shaped conductor located adjacent to the first island-shaped conductor, out of an edge of the first island-shaped conductor, in the arrangement direction of the island-shaped conductor group.

2. The antenna according to claim 1, wherein, when an effective wavelength in a space between the conductor plane and the island-shaped conductor group of an electromagnetic wave transmitted or received by the antenna is designated as $\lambda_0$, a size of the island-shaped conductor in the arrangement direction of the island-shaped conductor group is smaller than $\lambda_0/2$.

3. The antenna according to claim 1, wherein
adjacent two of the island-shaped conductors are capacitively connected by being close to each other.

4. The antenna according to claim 1, wherein
in the island-shaped conductor group, adjacent two island-shaped conductors are capacitively connected via an auxiliary conductor disposed so as to partially overlap with each of the adjacent two island-shaped conductors in planar view.

5. The antenna according to claim 1, wherein
the connection part is a conductor via.

6. The antenna according to claim 1, wherein
the connection part is configured by cascadedly connecting a conductor via and any one of a chip capacitance, a third island-shaped conductor, and a transmission line, and electrically connects the conductor plane and the first island-shaped conductor.

7. The antenna according to claim 1, wherein
the plurality of island-shaped conductors included in the island-shaped conductor group is two-dimensionally arranged so as to face the conductor plane.

8. The antenna according to claim 7, wherein
at least two or more of the power feeding parts are included,
at least one of the at least two or more of the power feeding parts is connected to a position other than a center of the island-shaped conductor in a first arrangement direction of the island-shaped conductor group,
another of the at least two or more of the power feeding part is connected to a position other than a center of the island-shaped conductor in a second arrangement direction of the island-shaped conductor group, and
a phase difference of power fed to the respective power feeding parts adjacent to each other in an outer circumferential direction of the island-shaped conductor group is greater than or equal to 60 degrees and smaller than 120 degrees.

9. A printed circuit board including an antenna, wherein
the antenna comprises:
a conductor plane;
an island-shaped conductor group including a plurality of island-shaped conductors arranged so as to face the conductor plane via a dielectric medium;
at least one power feeding part that is connected to one of the plurality of island-shaped conductors of the island-shaped conductor group and that transmits power; and
a connection part that electrically connects the conductor plane and a first island-shaped conductor that is the island-shaped conductor located on an outermost side of the island-shaped conductor group, wherein
each of the plurality of the island-shaped conductors is capacitively connected to another island-shaped conductor or other island-shaped conductors adjacent thereto,
the power feeding part is connected to a position other than a center of the island-shaped conductor in an arrangement direction of the island-shaped conductor group, and
the connection part is connected to a position in the first island-shaped conductor by approximately half a width of a second island-shaped conductor, from a portion facing the second island-shaped conductor that is the island-shaped conductor located adjacent to the first island-shaped conductor, out of an edge of the first island-shaped conductor, in the arrangement direction of the island-shaped conductor group.

10. An electronic device including an antenna, wherein
the antenna comprises:
a conductor plane;
an island-shaped conductor group including a plurality of island-shaped conductors arranged so as to face the conductor plane via a dielectric medium;
at least one power feeding part that is connected to one of the plurality of island-shaped conductors of the island-shaped conductor group and that transmits power; and
a connection part that electrically connects the conductor plane and a first island-shaped conductor that is the island-shaped conductor located on an outermost side of the island-shaped conductor group, wherein
each of the plurality of the island-shaped conductors is capacitively connected to another island-shaped conductor or other island-shaped conductors adjacent thereto,
the power feeding part is connected to a position other than a center of the island-shaped conductor in an arrangement direction of the island-shaped conductor group, and
the connection part is connected to a position in the first island-shaped conductor by approximately half a width of a second island-shaped conductor, from a portion facing the second island-shaped conductor that is the island-shaped conductor located adjacent to the first island-shaped conductor, out of an edge of the first island-shaped conductor, in the arrangement direction of the island-shaped conductor group.

* * * * *